US007277660B2

(12) United States Patent
Umeyama et al.

(10) Patent No.: US 7,277,660 B2
(45) Date of Patent: Oct. 2, 2007

(54) OUTER COVER ATTACHMENT STRUCTURE, FIXATION MEMBER OF APPARATUS, TRANSPORTATION METHOD OF APPARATUS, APPARATUS, AND IMAGE FORMATION DEVICE

(75) Inventors: Hiroyuki Umeyama, Kanagawa (JP); Tetsuhiro Kogawa, Kanagawa (JP); Keiichi Akatani, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 70 days.

(21) Appl. No.: 11/081,743

(22) Filed: Mar. 17, 2005

(65) Prior Publication Data

US 2005/0214022 A1 Sep. 29, 2005

(30) Foreign Application Priority Data

Mar. 18, 2004 (JP) ..... 2004-077551

(51) Int. Cl.
*G03G 15/00* (2006.01)

(52) U.S. Cl. ..... 399/107; 399/108; 399/109

(58) Field of Classification Search ..... 399/107, 399/108, 109, 110
See application file for complete search history.

(56) References Cited

U.S. PATENT DOCUMENTS 5,737,667 A * 4/1998 Okuda et al. ..... 399/108
6,647,226 B2 * 11/2003 Katakabe et al. ..... 399/108
7,106,990 B2 * 9/2006 Murano et al. ..... 399/108

FOREIGN PATENT DOCUMENTS

JP 2005-181511 7/2005

* cited by examiner

*Primary Examiner*—Hoang Ngo
(74) *Attorney, Agent, or Firm*—Oblon, Spivak, McClelland, Maier & Neustadt, P.C.

(57) ABSTRACT

Provided is an outer cover attachment structure which achieves the reduction of burden for collecting and recycling used products from the market, the reduction of replacement parts, and cost reduction of reproduced products. A housing portion housing the removed fixation members or connection members is provided to at least one of the paper feed trays. In the paper feed tray, a housing space is set behind the end face in the paper feed direction of the transfer paper. This position shall be a position that will not have an adverse effect on the paper feeding operation or paper replenishment of the paper feed tray. Two screw holes are provided inside the housing space, and a screw for fixing the fixation members to be housed are inserted into the screw hole so as to fix the fixation member or housing container. During the collection of an image formation device and the like, if the fixation member, connection member and so on that were removed and housed are used to collect the image formation device or the like, the collection quality will not deteriorate.

19 Claims, 24 Drawing Sheets

OUTER COVER ATTACHMENT STRUCTURE, FIXATION MEMBER OF APPARATUS, TRANSPORTATION METHOD OF APPARATUS, APPARATUS, AND IMAGE FORMATION DEVICE

BACKGROUND OF THE INVENTION

1. Field of the Invention

The present invention relates to an apparatus and image formation device to be collected for recycling, and to an outer cover attachment structure suitable therefor, and a transportation method of such an apparatus.

2. Description of the Related Art

In an image formation device constituted as an electronic copier, printer, facsimile or a complex machine comprising at least two of these functions, fixation members are often used for protecting components and units from vibration and protecting these from damage during the transport or storage up to the delivery to the user. These fixation members are to be removed from the fixed locations prior to the user using the image formation device. And, although the delivery people often take home the removed fixation members, the place for housing such members is not determined, and in many cases these members are not taken back and are disposed.

Meanwhile, from the perspective of protecting the environment and effectively using resources in recent years, many of the image formation devices are being recycled. During recycling, the used products are collected from users, cleaning and reproduction processing are performed to the overall product, units and components, and then placed on the market once again with quality assurance. Nevertheless, there are cases where the units or components would be damaged during the collection or transport thereof, and become unsuitable for recycling.

An information formation device capable of housing the fixation means after the delivery thereof has been proposed (for example, c.f. Japanese Patent Laid-Open Publication No. H10-97114). Still, with this device, the fixation means are limited to those for fixing the scanner unit of the image formation device having an automatic paper feeding device, and this could not be applied to other units that need to be fixed, such as the development unit or intermediate transfer unit.

Further, in the collected machine of a used image formation device, scratches and damages are often found on the outer cover surface. The primary cause of such scratches and damages is because the members and components that should be removed upon collecting the used product from the user are not removed, and, therefore, the convex portions of such components come in contact with the outer cover and the like. Or, workers may consciously damage such components. The damaged outer cover and the like can no longer be reused, and must be replaced. In such a case, the number of components that must be replaced with new components will increase, and the cost for reproducing the product will also increase.

Further, even if the members and components to be removed are removed at the stage of collecting the used image formation device from the market, since there is no container for housing the removed components and screws, there are many cases where the removed members and the like are randomly placed inside the product, which results in scratches or damages to the device, or the loss of small items such as the removed screws and the like. Then, disassembly procedures will become necessary to find the lost screws and the like, which will increase the number of processing steps for reproduction, and the reproduction cost will increase as a result thereof.

Further, with the actual recycling being conducted today, there are many cases where the hook on the inside of the outer cover of the collected machine is damaged. One reason this kind of damage occurs is because the number of joining screws for attaching the outer cover is reduced as much as possible, and a hook system is adopted in place thereof in light of simplifying the attachment, assembly and detachment of the outer cover. In other words, the repairmen who are conducting the maintenance of products operating in the market damage the hook by carelessly applying strong force upon opening the cover. Further, many of the vendors that disassemble the collected machine do not know how to remove the outer cover, or are not familiar with the process, and often damage the hook on the inside of the outer cover. The damaged outer cover and the like can no longer be reused, and must be replaced. In such a case, the number of components that must be replaced with new components will increase, the number of processing steps for reproduction will increase, and the cost for reproducing the product will also increase.

Meanwhile, in order to recycle an image formation device, the image formation device is sent from the user to the collection center, and from the collection center to the reproduction center. Unlike a new product, a reproduced product is not packaged upon its transportation, and is being transported nearly naked. Thus, the adjacent image formation devices would come in contact with each other during the transportation, and the outer cover is easily scratched, and options such as manual paper feed units and double-sided units are easily damaged, and this is becoming a significant hindrance for recycling.

SUMMARY OF THE INVENTION

Thus, in the light of the conventional circumstances described above, an object of the present invention is to provide an outer cover attachment structure capable of preventing the outer cover from becoming damaged, and which can be easily attached and detached, for seeking the reduction of burden for the collection and reproduction, the reduction of replacement parts, and cost reduction of reproduced products in the recycle of collecting and reusing used products from the market.

Moreover, another object of the present invention is to provide a transportation method of an apparatus and a fixation member to be used in a used apparatus such as an image formation device which will suppress damages to the components or units and will not deteriorate the collection quality upon collecting such apparatus.

Further, another object of the present invention is to provide an apparatus such as an image formation device capable of housing the removed components and screws inside to prevent such items from scattering.

In accordance with the present invention, an outer cover attachment structure for attaching an outer cover to an apparatus case comprises a fitting protrusion at the inside of said cover; and a hollow retention member for fitting and retaining said protrusion at the side of said apparatus case.

In accordance with the present invention, an apparatus position fixing body to be attached to the legs or travelling members provided to the bottom part of the apparatus for fixing the position of the apparatus comprises a fixation portion for restricting the movement of said apparatus by fitting said legs or travelling members therein; and a leg portion for disposing said fixation portion at a position that is lower than the bottom part of said apparatus.

In accordance with the present invention, a transportation method of an apparatus employs a position fixing body of an apparatus for the transportation. The apparatus position fixing body to be attached to the legs or travelling members provided to the bottom part of the apparatus for fixing the position of the apparatus comprises a fixation portion for restricting the movement of said apparatus by fitting said legs or travelling members therein; and a let portion for disposing said fixation portion at a position that is lower than the bottom part of said apparatus.

In accordance with the present invention, an apparatus, comprises a connection member for connecting a peripheral device to the apparatus body; and a fixation member to be used for preventing the damage or the like of components and units inside said apparatus body upon transporting or moving said apparatus body. A housing container is capable of housing said connection member and fixation member, and components for attaching said connection member to said apparatus body is provided fixably to said apparatus body.

In accordance with the present invention, an apparatus comprises a connection member for connecting a peripheral device to the apparatus body; and a fixation member to be used for preventing the damage or the like of components and units inside said apparatus body upon transporting or moving said apparatus body. A housing portion is capable of housing said connection member and fixation member, and components for attaching said connection member to said apparatus body is provided as a dead space inside said apparatus body.

In accordance with the present invention, an image formation device comprises a connection member for connecting a peripheral device to the image formation device body; and a fixation member to be used for preventing the damage or the like of components and units inside said image formation device body upon transporting or moving said image formation device body. A housing portion is capable of housing said connection member and fixation member, and components for attaching said connection member to said image formation device body is provided as a dead space inside said image formation device body.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1A:
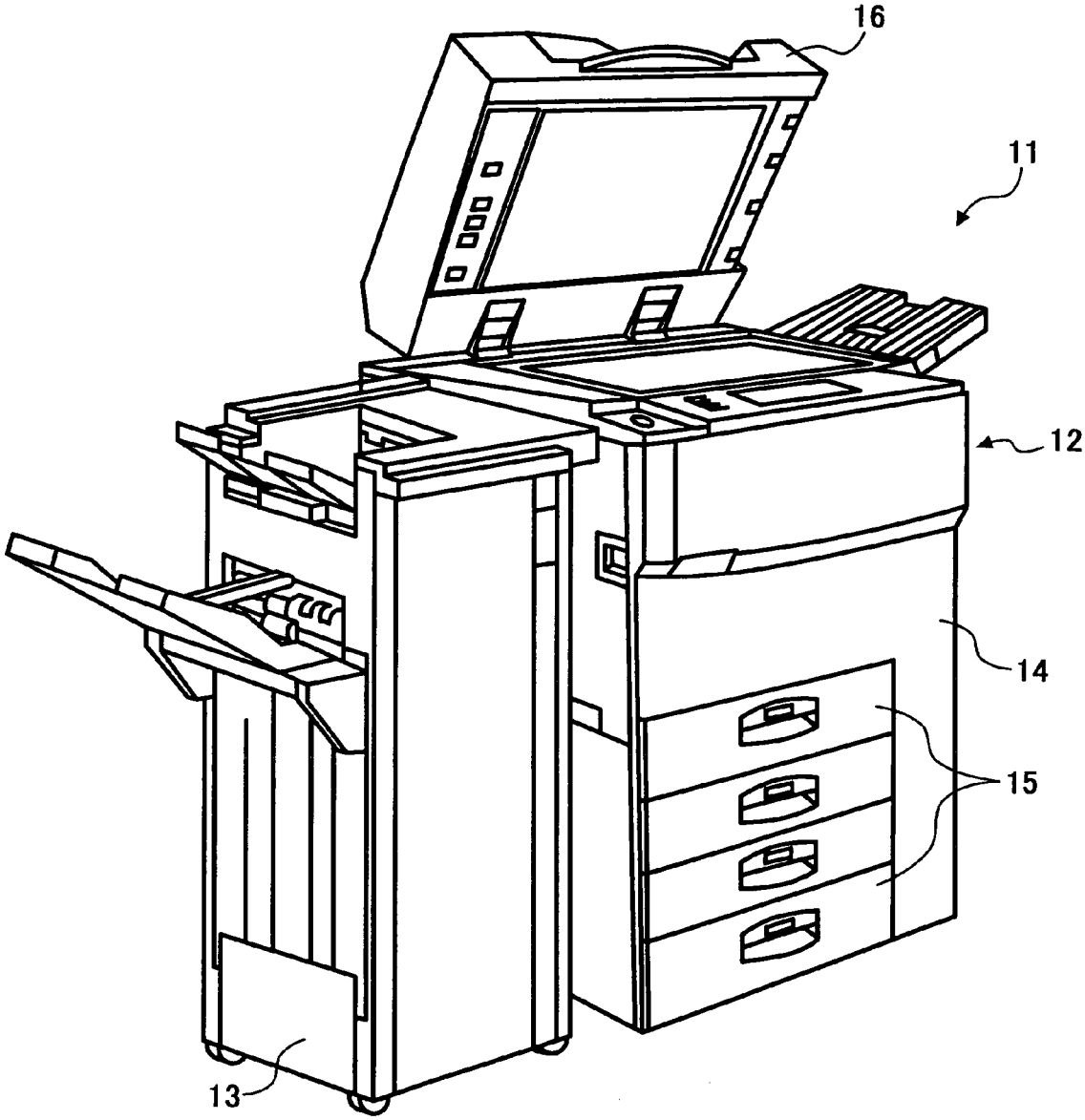
FIG. 1A is a perspective view showing the appearance of an example of the image formation system according to the respective embodiments of the present invention.

The respective embodiments according to the present invention are now explained with reference to the drawings. Incidentally, components that are common in the respective embodiments are given the same reference numeral in the following description, and the redundant explanation thereof is omitted.

Embodiment 1

Figure 1B:
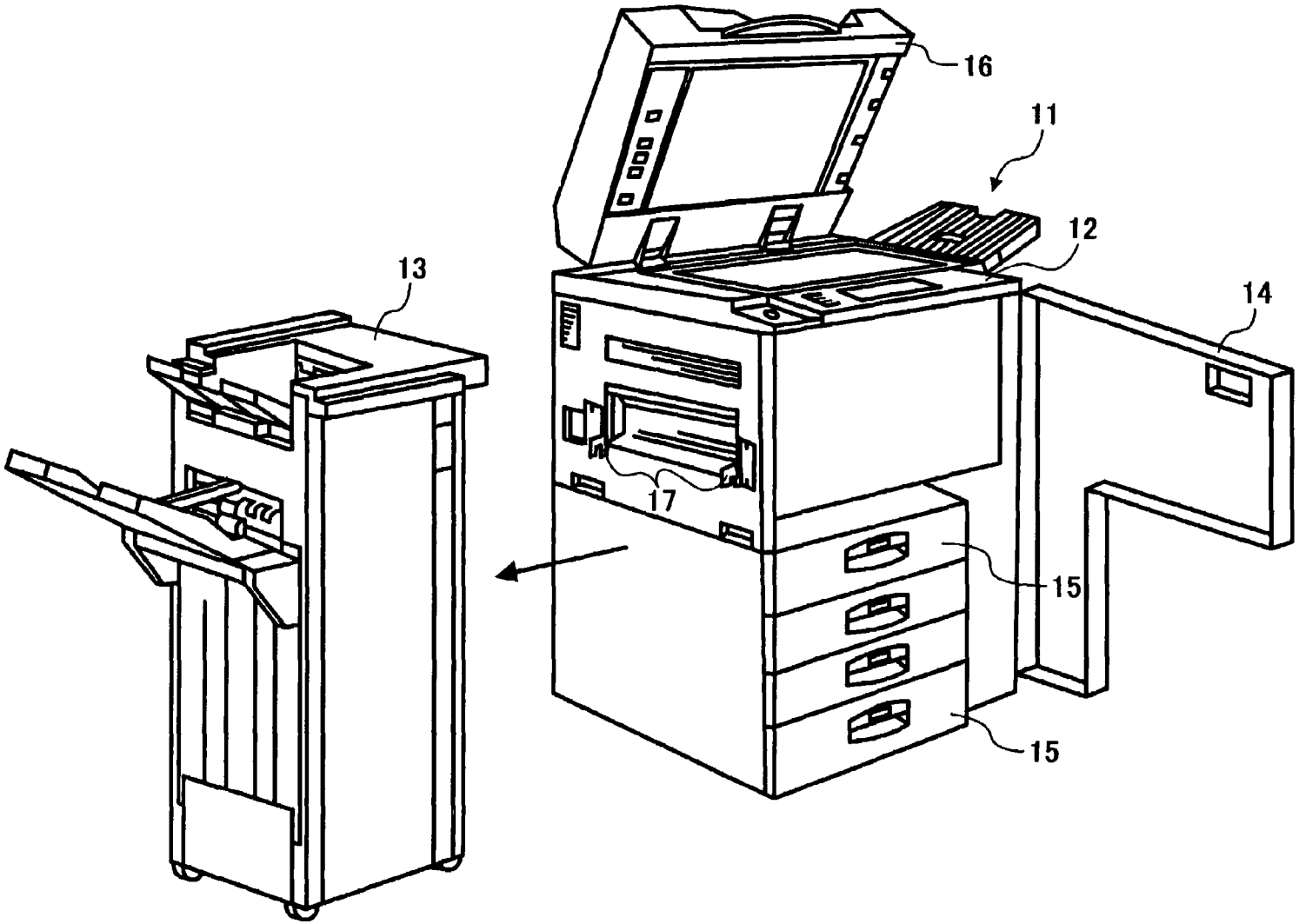
FIG. 1B is an exploded perspective view thereof.

FIGS. 1A and 1B show the constitution of an example of the image formation system according to the present embodiment. The illustrated image formation system is of a system configuration in which a finisher 13, which is a peripheral device, is connected to the device body 12 of an image formation device 11. The device body 12 of the image formation device 11 comprises a front door 14, in a freely openable and closable manner, for accessing the internal structure (not shown) of the development unit and the like, as well as a front loading type 4-tier paper feed tray 15. Incidentally, reference numeral 16 is an automatic document feeder (ADF).

Figure 2A:
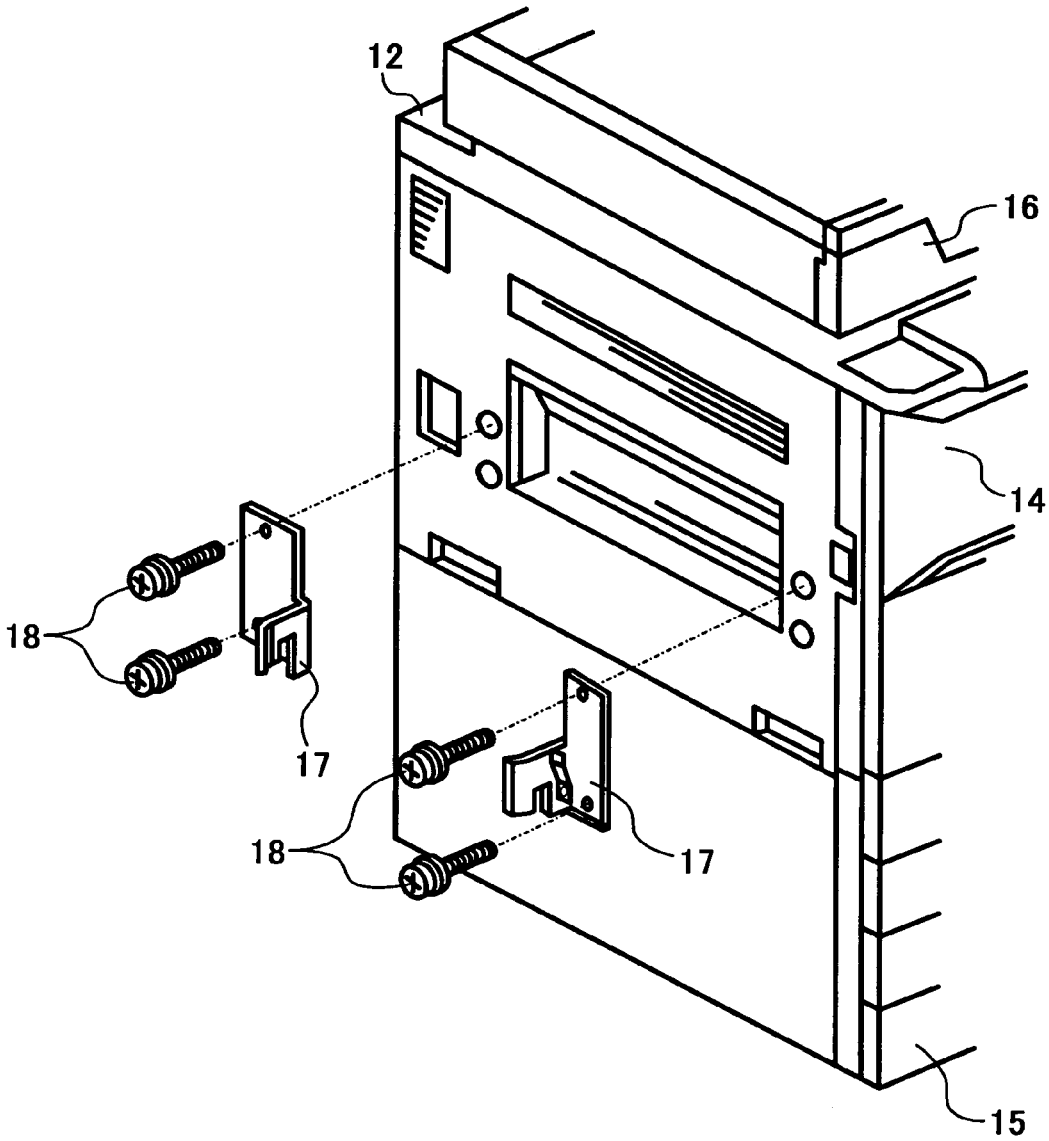
FIG. 2A is an exploded perspective view showing the constitution of the bracket and the like for connecting the image formation device and finisher.
Figure 2B:
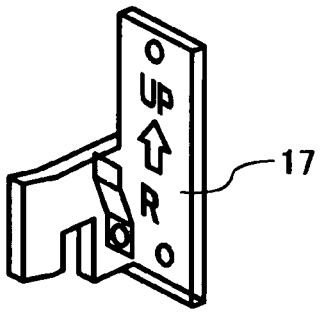
FIG. 2B is an enlarged perspective view of the bracket.

FIGS. 2A and 2B show the brackets 17, 17 and fixing screws 18 for connecting the finisher 13 to the side face of the device body 12 of the image formation device 11. These brackets 17 and fixing screws 18 will be housed in the housing container described later. Incidentally, a pair of brackets 17, 17 are symmetrical in the front and back of the device body 12.

Figure 3:
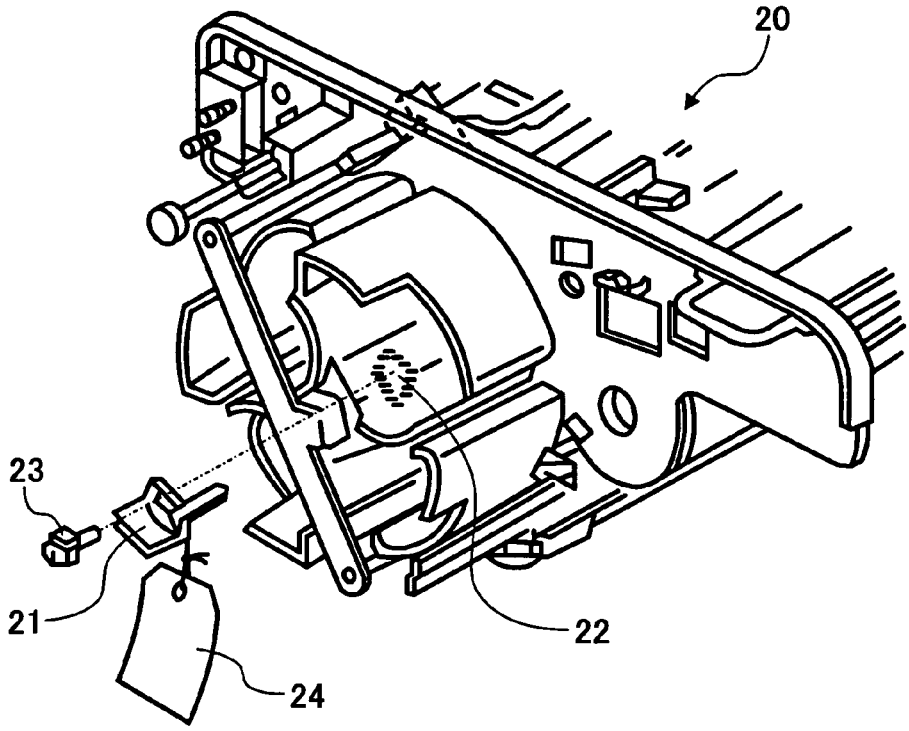
FIG. 3 is a perspective view showing a part of the internal constitution of the image formation device.
Figure 4:
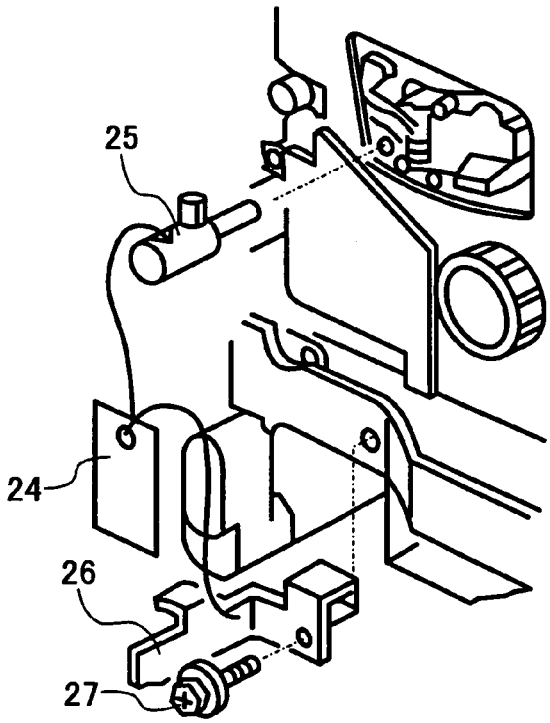
FIG. 4 and FIG. 5A to 5C are perspective views showing the constitution of the respective fixation members of other components.
Figure 5A:
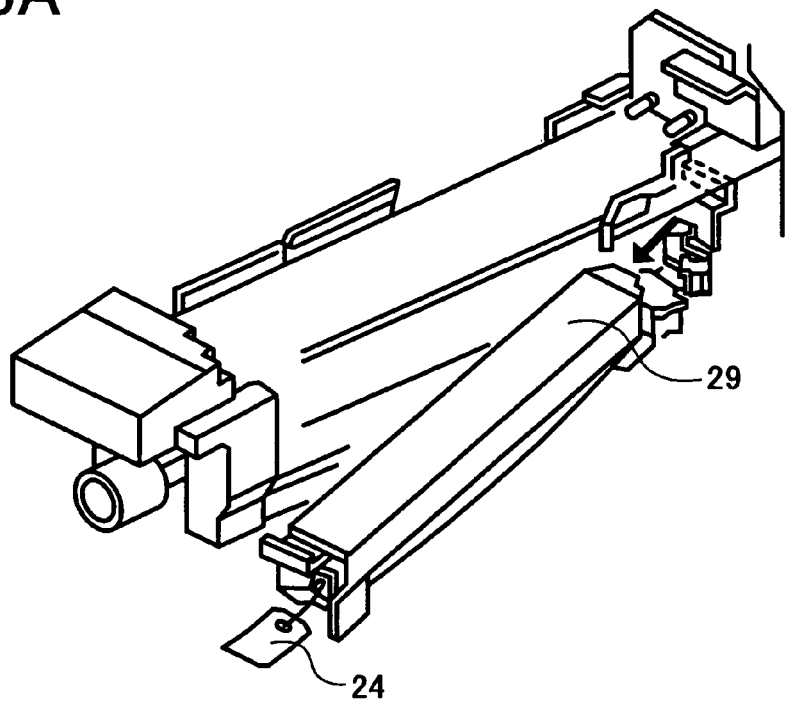
Figure 5B:
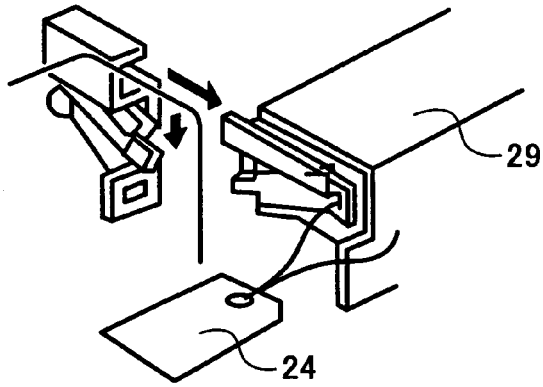
Figure 5C:
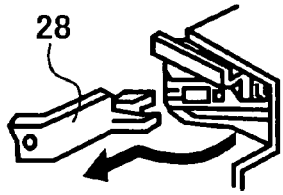

FIG. 3 shows the internal structure of a part of the image formation device 11, and reference numeral 20 is the revolver type development unit that is movably fixed with the fixation member described later. This development unit 20 can be non-rotatably fixed by attaching the fixation member 21 to the attachment portion 22. Further, as a result of the fixation member 21 being joined with a screw 23 as the joining member, it will not disengage from the attaching portion 22 due to vibration or the like. Incidentally, the movable portion of the image formation device fixed with the fixation means subject to the present embodiment is not limited to the revolver type development unit, and other units, such as the intermediate transfer unit or the like may also be employed. Further, although the location that is fixed with the fixation member is explained as the movable portion, so as long as the location employs the fixation member, this is not limited to the movable portion.

This type of fixed member 21 is attached to the image formation device 11 in advance by the manufacturer at the time of delivering the new product, but is removed by the service worker after the delivery is completed. The removed fixation member 10 is easily disposed or lost even when a recognition member such as a tag 24 is affixed thereon. When the image formation device 11 is no longer used and is to be collected, unless a substitute means is prepared, the development unit 20 cannot be fixed, and the development unit 20 may become damaged as described above.

FIG. 4 and FIG. 5A to 5C show examples of other fixation members. Reference numeral 25 is a pressure release pin of a photo conductor cleaning blade, reference numeral 26 is a fixation member of a transfer belt unit, reference numeral 27 is a fixing screw thereof, and reference numeral 28 is a fixation member for an oil application unit 29 of the fastening unit. These are also easily disposed or lost even when a tag 24 is affixed thereon.

Figure 6A:
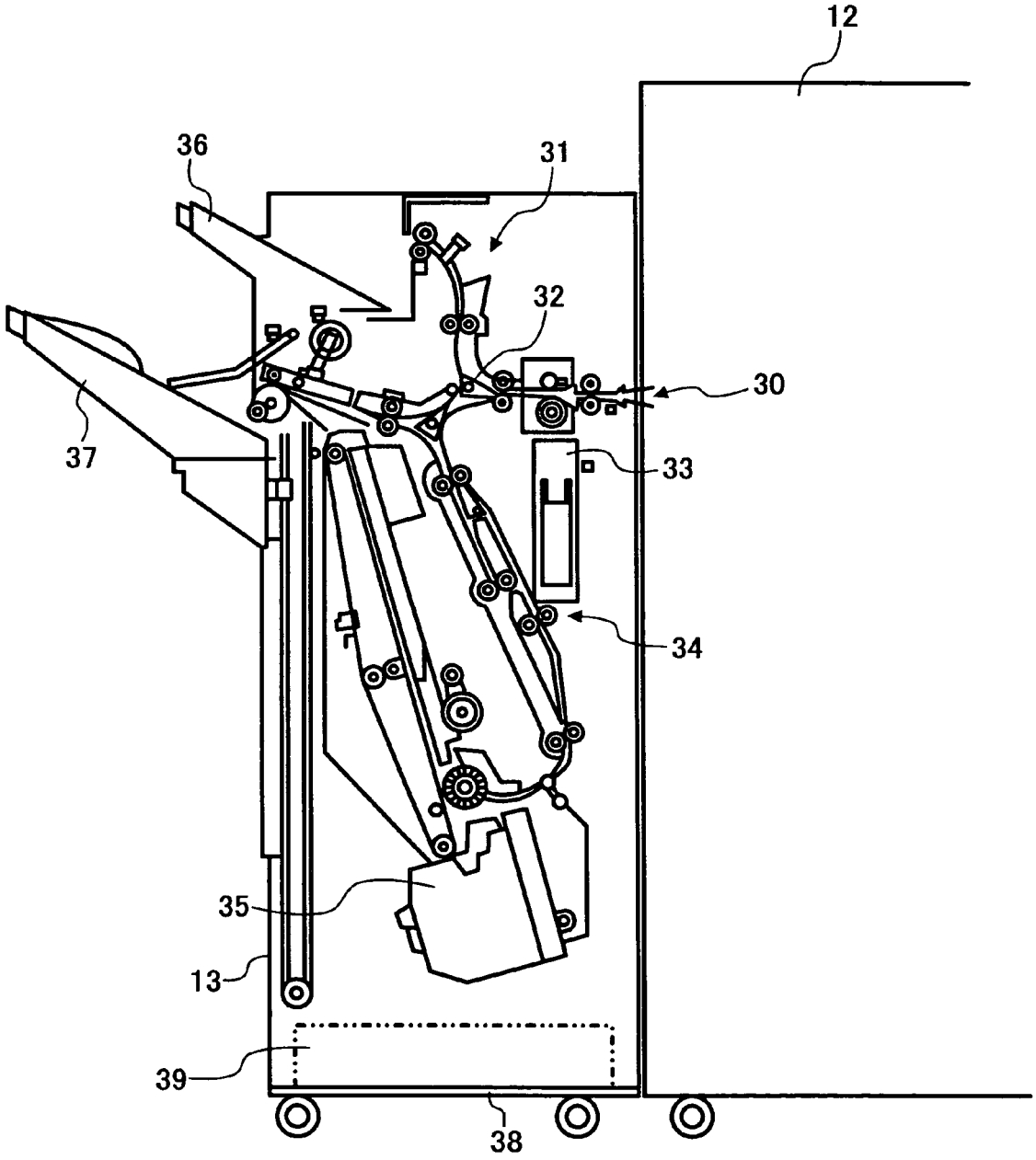
FIG. 6A is a cross section showing the finisher, which is a peripheral device.
Figure 6B:
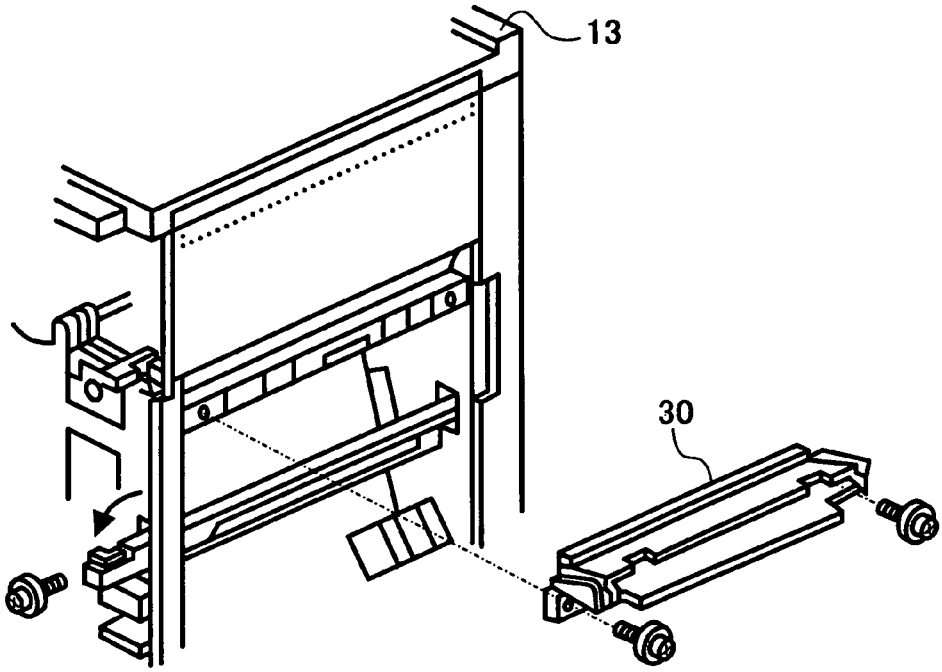
FIG. 6B is the perspective view showing the constitution of the upper part thereof.
Figure 6C:
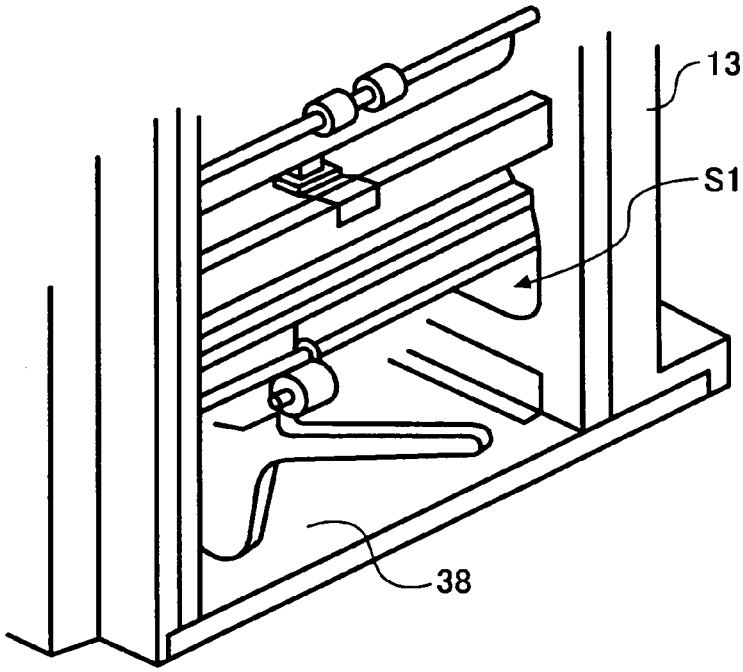
FIG. 6C is a perspective view showing the constitution of the lower part thereof.

FIGS. 6A and 6B show the finisher 13 as a peripheral unit. FIGS. 6B and 6C are diagrams viewing the illustration of FIG. 6A from the side. This finisher 13 has a relay guide plate 30 for transferring the photocopied transfer paper reliably inside the peripheral device at a portion of connecting to the transport path inside the device body 12, and, in addition to the transport path 31 and branch claw 32 in communication therewith, it also comprises a punch unit 33, a pre-stack tray 34, a stable unit 35, a proof tray 36, a shift tray 37 and so on, and the open space S1 above the bottom plate 38 is used so as to enable the housing container 39 housing the removed components to be attached thereto.

Embodiment 2

Figure 7A:
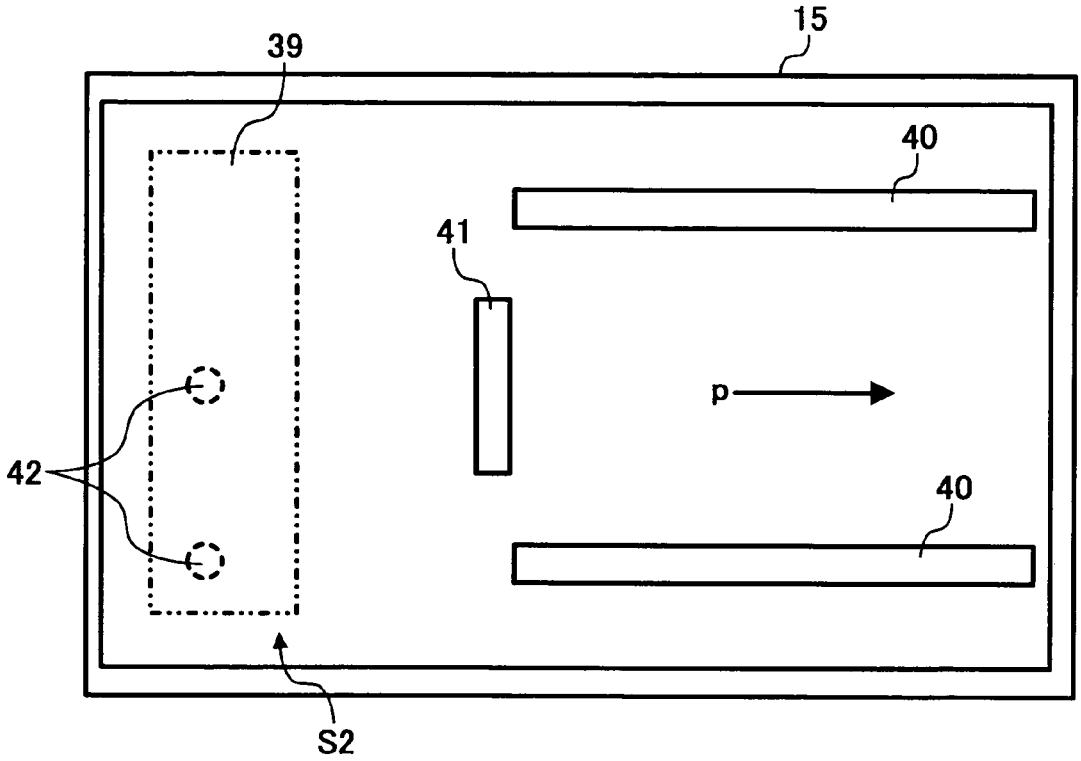
FIG. 7A is a plan view showing an example of providing a housing unit for housing the removed fixation member to the paper feed tray.
Figure 7B:
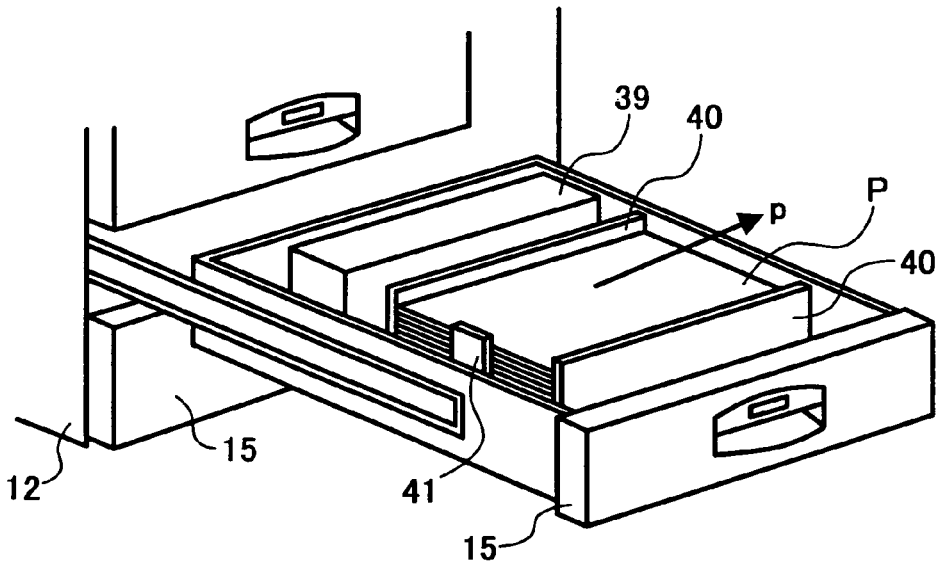
FIG. 7B is a perspective view thereof.

FIGS. 7A and 7B show an embodiment of providing the housing portion housing the removed fixed members to at least one of the paper feed trays 15 most suitable for long term storage. The paper feed tray 15 can be classified into a fixed tray that is used without hardly changing the size of the housed transfer paper P and which the size change is conducted with a tool; a universal tray capable of changing the position of the side fences 40, 40 and the end fence 41 without requiring any tools, and a tandem tray comprising a transport mechanism of the transfer paper P. The paper feed tray 15 to which the housing space S2 of the fixed members is to be provided may be of an arbitrary position and type, and it is most preferable to use a fixed tray fixed to a size other than the maximum size of paper since an open space can be secured.

Thus, in the example shown in FIGS. 7A and 7B, the housing space S2 is set behind the end fence 41 (upstream of the paper feeding direction) in the paper feeding direction of the transfer paper P shown with the arrow p, and is in a position which will not have an adverse effect on the paper feeding operation or paper replenishment of the paper feed tray 15.

Thus, in the example shown in FIGS. 7A and 7B, two screw holes 42, 42 are provided inside the housing space S2. The screws for fixing the fixation members can be inserted into the screw holes 42 to fix the fixation members or housing container 39, and the housing and storage can be conducted even more effectively.

Embodiment 3

Figure 8:
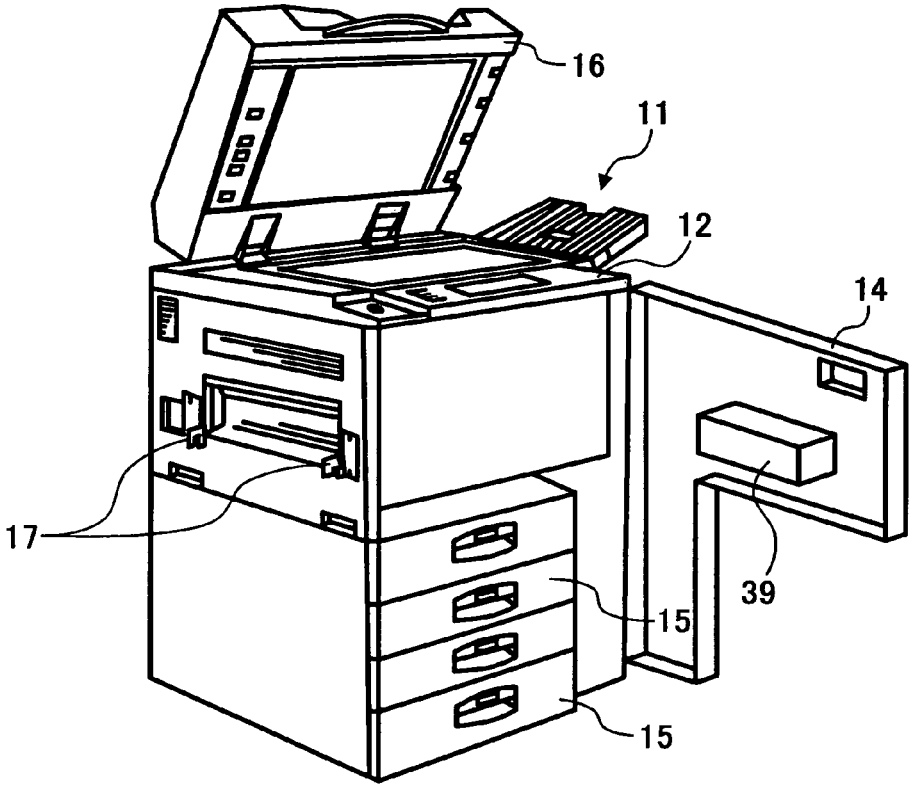
FIG. 8 is a perspective view showing an example where the portion to which the housing container is to be provided is the inner face of the front door.

FIG. 8 shows an embodiment in which the portion to provide the housing container 39 is the inside face of the front door 14.

Embodiment 4

Figure 9:
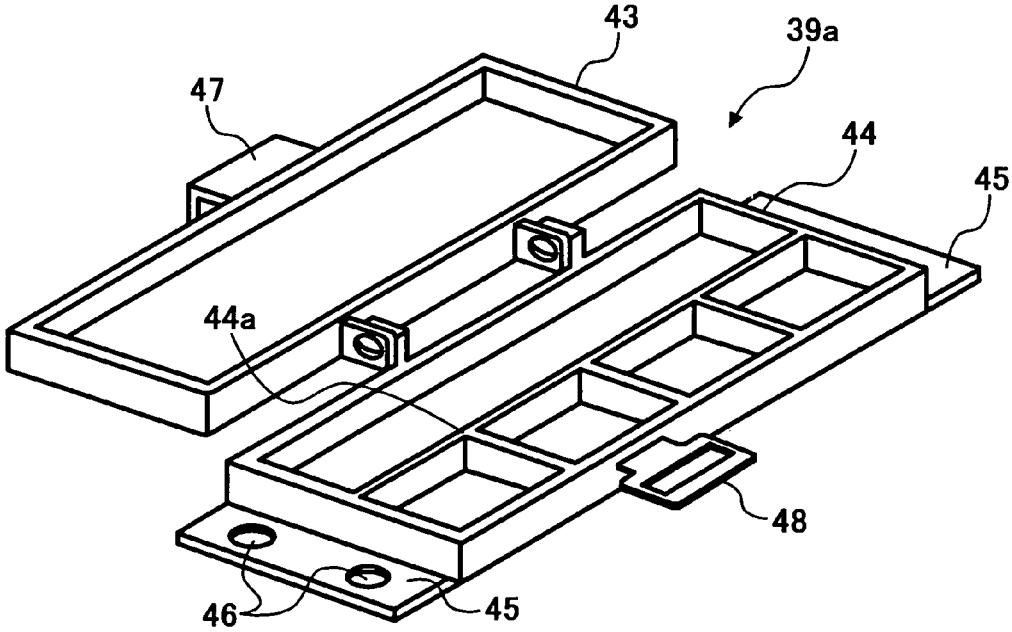
FIG. 9 is a perspective view showing the constitution of an example of the housing container.

FIG. 9 shows an example of the housing container. This housing container 39*a* is formed from a cover 43 and container portion 44 molded from a material such as resin having flexibility, the inside of the container portion 44 is partitioned into several sections according to the size of the components so as to enable various fixation members to be housed, and the non-removal of the fixation members and management of quantity thereof can be conducted visually. Further, a pair of attaching portions 45 is provided to the outside thereof, screw holes 46, 46 are formed thereto, and these screw holes 46 are used to fix the housing member at a prescribed position with screws. Further, this housing container 39*a* comprises stoppers 47, 48 in the cover 43 and container portion 44, respectively.

Figure 10A:
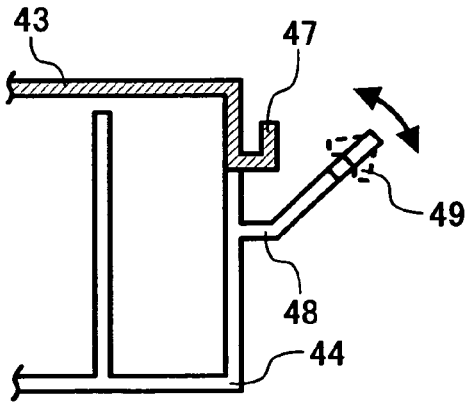
FIGS. 10A and 10B are cross sections for explaining the opening/closing motion of the cover of the housing container.
Figure 10B:
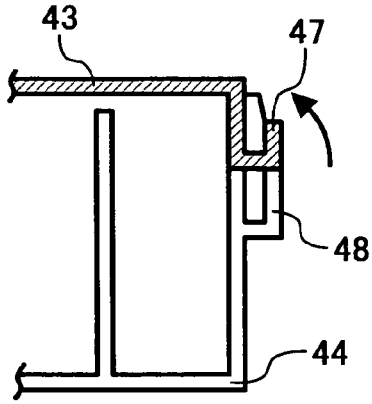
Figure 10C:
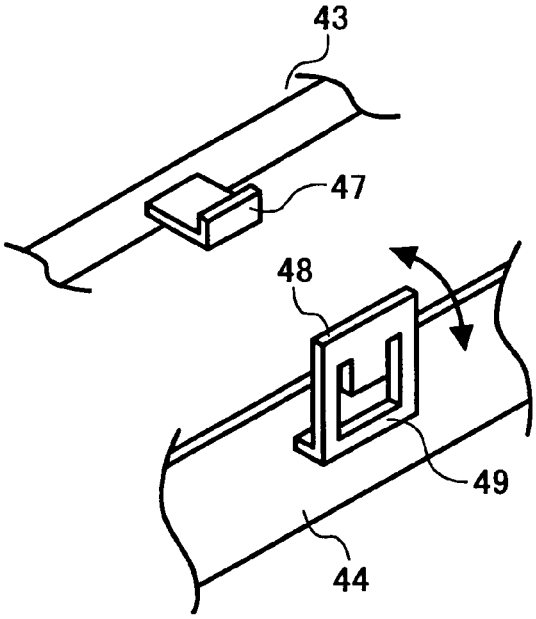
FIGS. 10C and 10D are perspective views thereof.
Figure 10D:
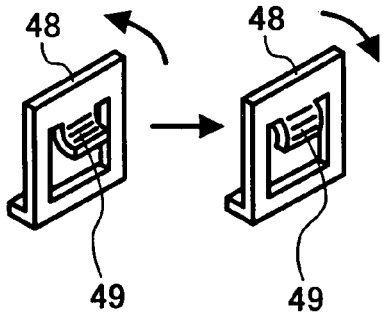

The opening/closing operation of the cover 43 of the housing container 39*a* illustrated in FIG. 9 is now explained with reference to FIG. 10A to 10D. As shown FIG. 10A, when the stopper 48 is raised and bent in a state where the cover 43 is open, the tongue piece 49 of the stopper 48 will come in contact with the stopper 47, and, as shown in FIG. 10D, it will bend, go over the stopper 47, and engage therewith. Needless to say, although the cover 43 will prevent the housed components from scattering, if the partition 44*a* is made to adhere to the lower face of the cover 43, the housed components will not get mixed up. Further, since the cover 43 an be locked with the stoppers 47, 48 as described above, the housed items will not scatter while the collected product is being transported. This will contribute to the quality securement upon reuse, reduction of disassembly procedures, and reduction in costs of reproducing image formation devices.

Embodiment 5

Figure 11:
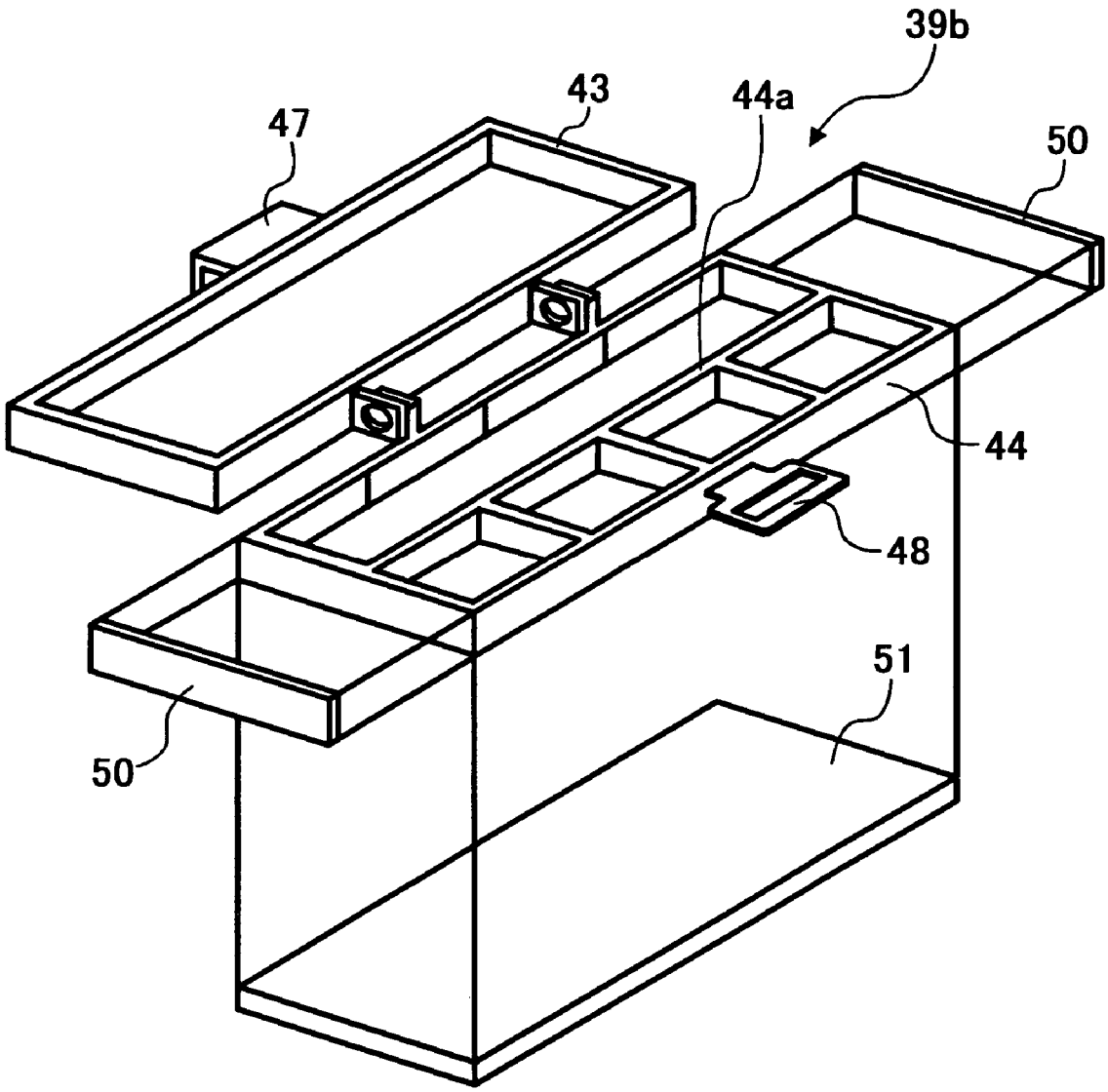
FIG. 11 is a perspective view showing the constitution of another example of the housing container.

FIG. 11 is a perspective view showing another example of the housing container. This housing container 39*b* is formed from a cover 43 and container portion 44 as with the example depicted in FIG. 9, but does not comprise an attachment portion 45, and adhesives 50, 51 such as a magnetic sheet or double sided tape is attached to the side face or bottom face of the container portion 44, and this is used to fix the housing container at a prescribed position. Needless to say, if this kind of fixation is not required, the adhesive may be omitted.

Embodiment 6

Figure 12A:
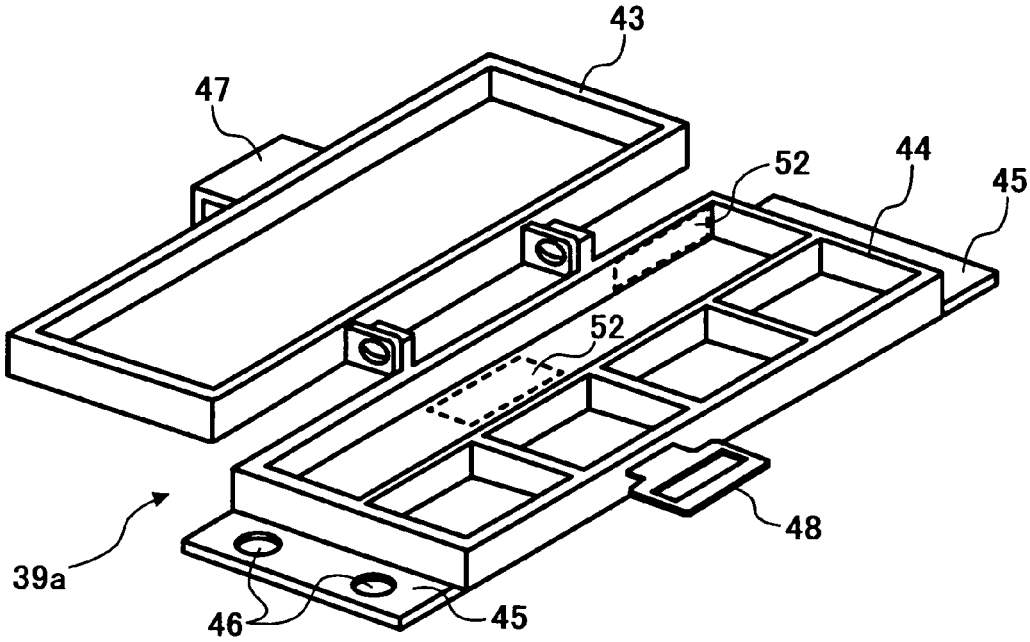
FIG. 12A is a perspective view showing the constitution of yet another example of the housing container.
Figure 12B:
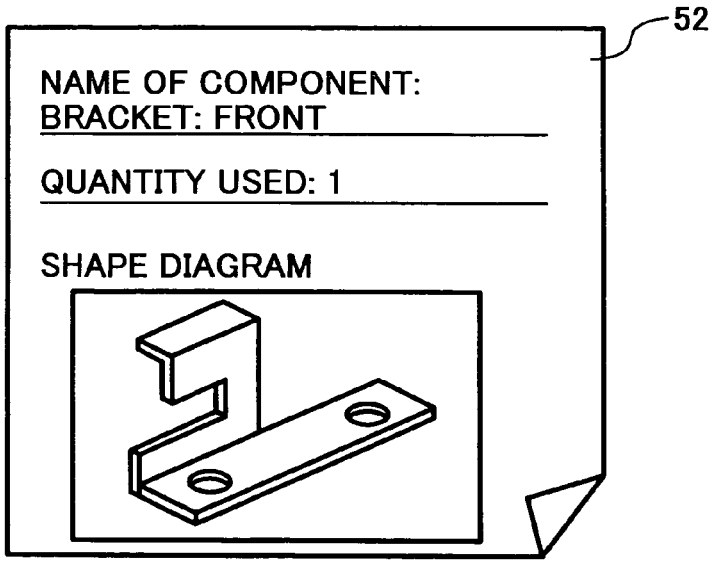
FIG. 12B is a plan view thereof.

FIGS. 12A and 12B show yet another example of the housing container. In this example, the housing container 39*a* illustrated in FIG. 11 is formed from transparent resin to enable the easy confirmation of the fixation members housed in the partitions from the outside, and a decal (or a sticker, hereinafter the same) 52 indicating the name of component, drawing, illustration and so on for each fixation member to be housed is affixed to the bottom or side of the partition. Incidentally, although not illustrated, this is the same for the housing container 39*b* and other housing containers.

Embodiment 7

Figure 13A:
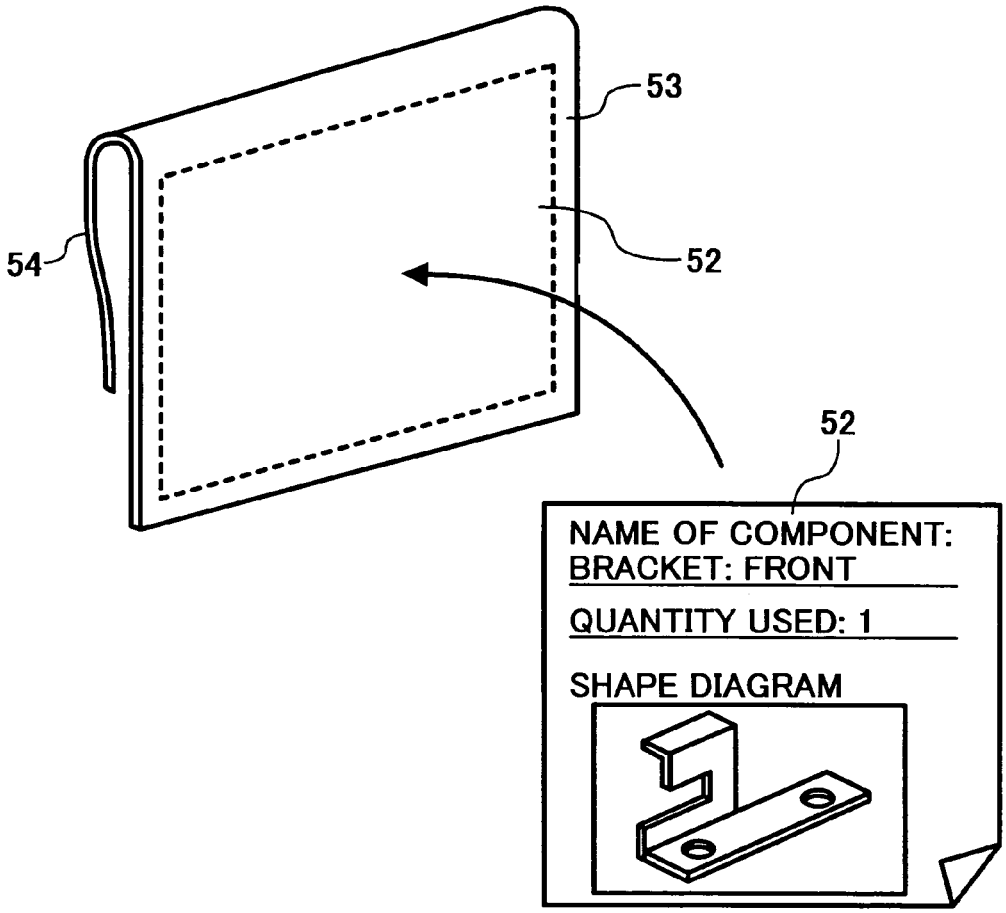
FIG. 13A is a perspective view showing the constitution of yet another example of the housing container.
Figure 13B:
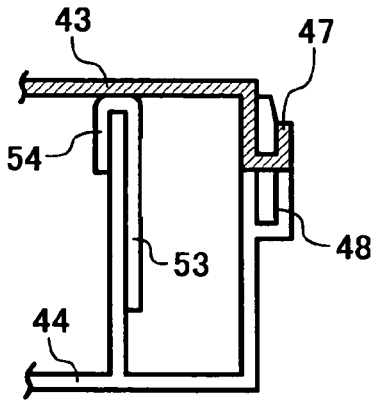
FIG. 13B is a plan view thereof.

FIGS. 13A and 13B show yet another example of the housing container. In this example, a plate 53 for sandwiching the outer wall of the housing container 39*a* or the partition wall is used, and the decal 52 shown in FIG. 12B is affixed to this plate 53. Thus, the plate 53 is folded back at the upper part thereof to form a clip portion 54. Incidentally, a bag-shaped portion may be provided to the plate 53, and the decal 52 may be placed therein.

Embodiment 8

Figure 14A:
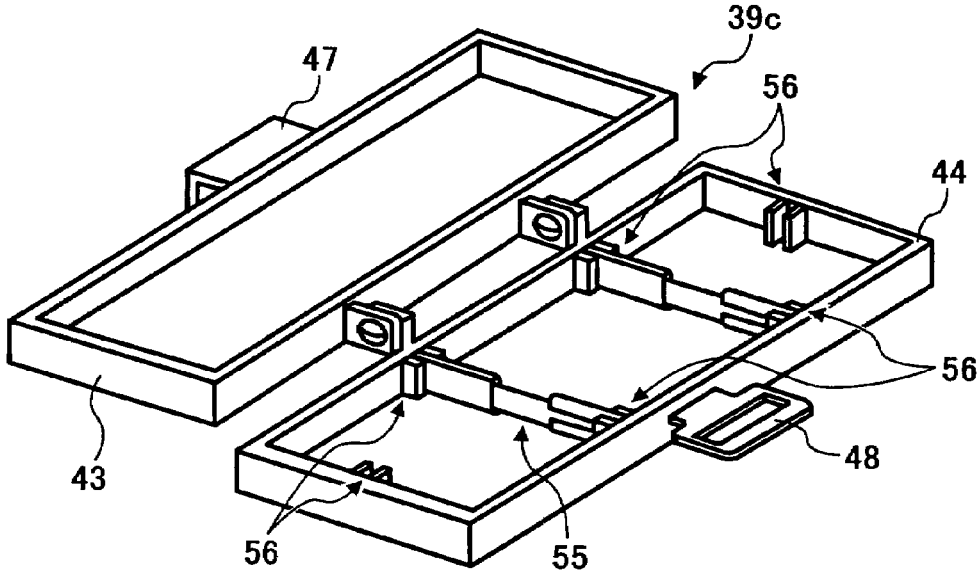
FIG. 14A is a perspective view showing the constitution of still yet another example of the housing container.
Figure 14B:
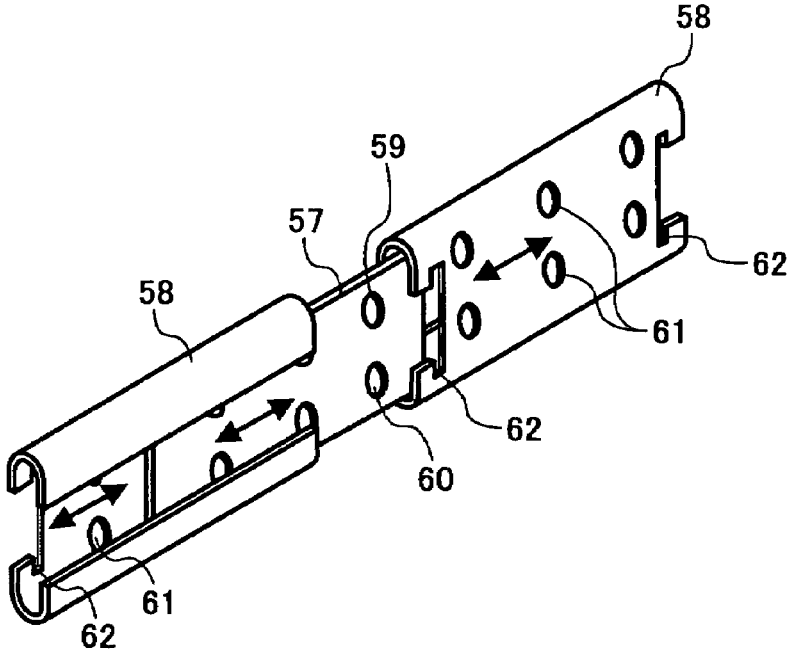
FIG. 14B is a perspective view showing the appearance of a partition body.

FIGS. 14A and 14B show yet another example of the housing container and a partition body. In this example, grooves 56 for inserting the partition body 55 for sectioning the inner wall of the housing container 39*c* are provided facing each other, and various partitions can be changed as a result thereof.

Figure 15:
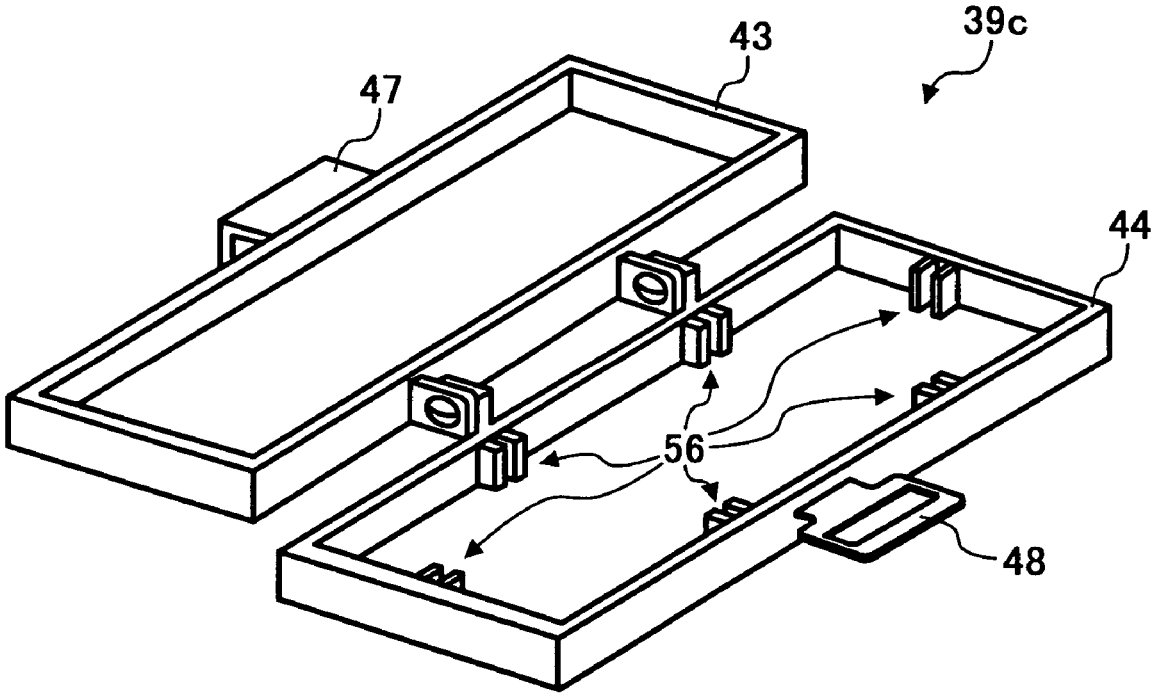
FIG. 15 is a perspective view showing the constitution of the housing container in which the partition body is removed.
Figure 16A:
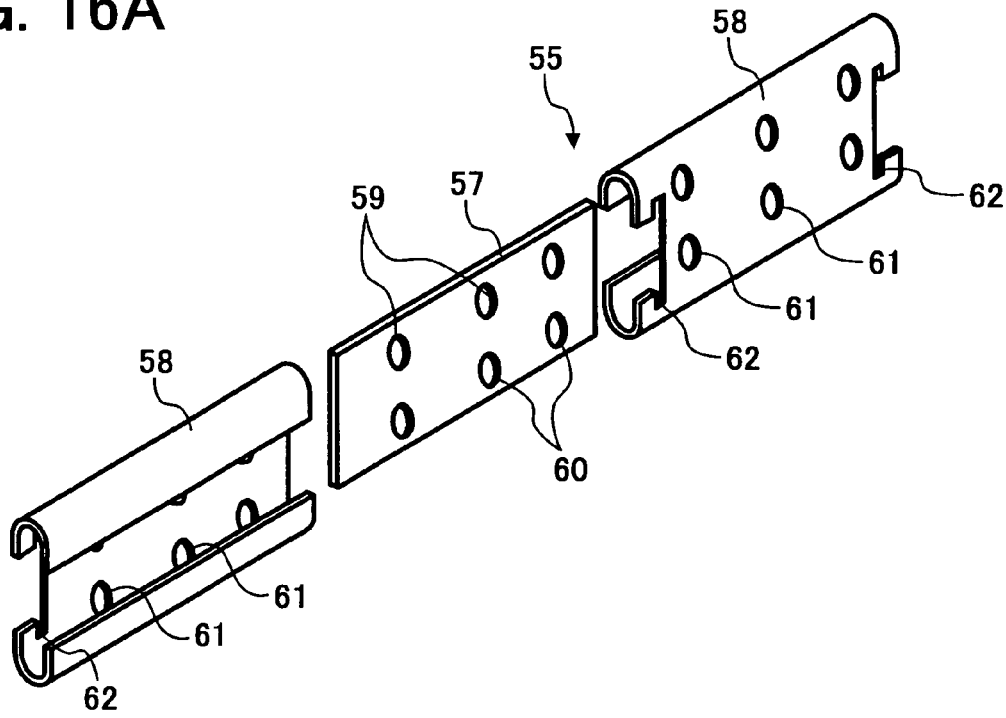
FIG. 16A is an enlarged perspective view showing the constitution of the partition body.
Figure 16B:
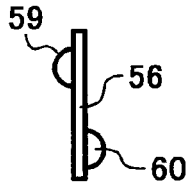
FIG. 16B is a side view showing the planar member constituting the partition body.
Figure 16C:
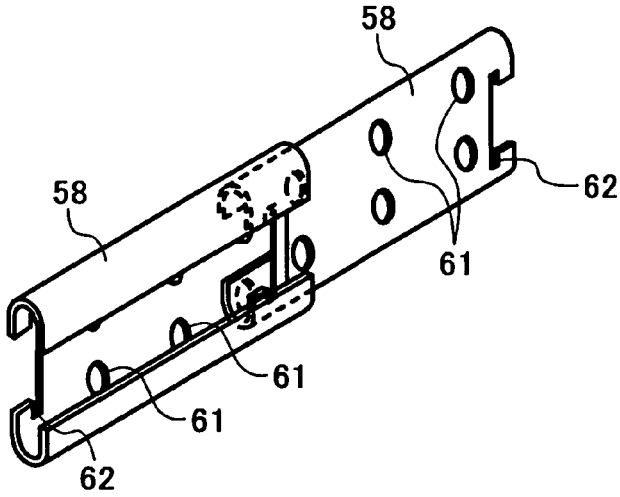
FIG. 16C is a perspective view showing the combination of a groove-shaped body.

FIG. 15 shows the housing container 39*c* with the partition body 55 removed from the state depicted in FIGS. 14A and 14B. FIG. 16A to 16C show the constitution of the partition body 55, the planar member constituting the partition body 55, and the combination of a groove-shaped body. In this example, the partition body is formed from a planar member 57 and a pair of groove-shaped bodies 58, 58, and the planar member 57 can be inserted into the groove of the groove-shaped body 58. The planar member 57 is literally a flat member, and a plurality of spherical convex portions 59 is provided to the left side in the drawing at the upper side thereof, and a plurality of spherical convex portions 60 is similarly provided to the right side in the drawing at the lower side thereof. Further, the groove-shaped body 58 is provided with a plurality of holes 61 at the top and bottom, and there are 6 holes provided at the top and bottom, respectively, and the illustrated example.

And, these are combined as shown in FIG. 14B such that the planar member 57 enters into the groove-shaped body 58, and the engagement position of the convex portions 59, 60 and the holes 61 is varied to extend or contract the length of the partition body 55. For example, the mode of attaching the partition body 55 inside the housing container 39*c* can be constituted to be in an arbitrary length by changing the position according to the size of the fixation member or the like to be housed, or sliding the planar member 57 and groove-shaped body 58 arbitrarily according to the size of the housing container 39*c*. Incidentally, the groove-shaped body 58 can be combined as depicted in FIG. 16C, and can be housed as short as possible when it is not being used.

Figure 17:
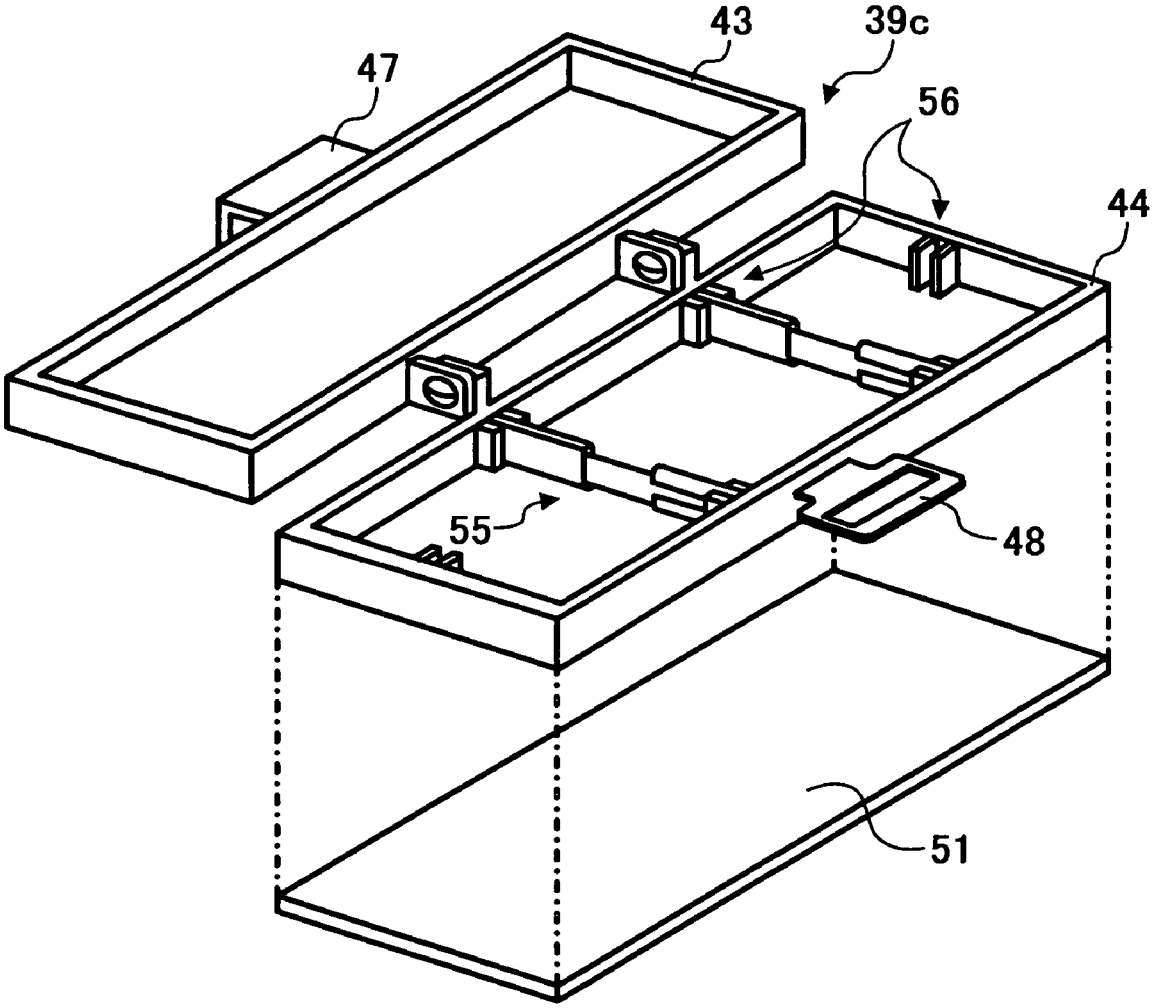
FIG. 17 is a perspective view showing the state of fixing the housing container illustrated in FIGS. 14A and 14B to a prescribed position.

FIG. 17 is shows a mode of fixing the housing container 39*c* illustrated in FIGS. 14A and 14B at a prescribed position. In this example, as with the case described with reference to FIG. 11, adhesives 51 such as a magnetic sheet or double sided tape is attached to the side face or bottom face of the container portion 44, and this is used to fix the housing container at a prescribed position. Needless to say, if this kind of fixation is not required, the adhesive may be omitted.

Embodiment 9

Figure 18A:
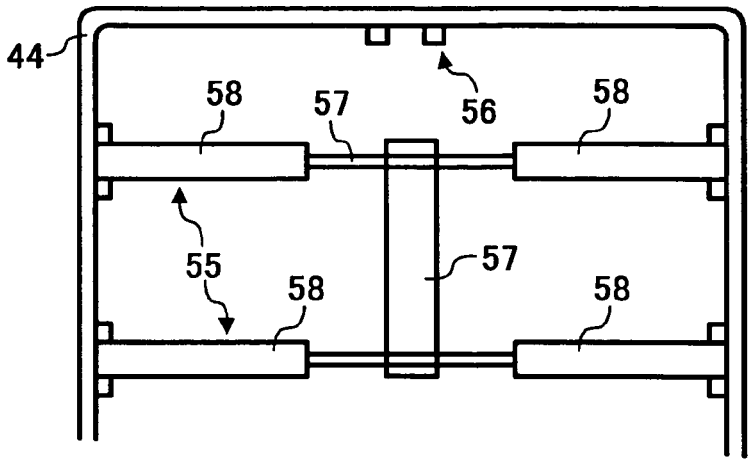
FIG. 18A is a plan view showing a modified example of the respective components illustrated in FIG. 14A to FIG. 16C.
Figure 18B:
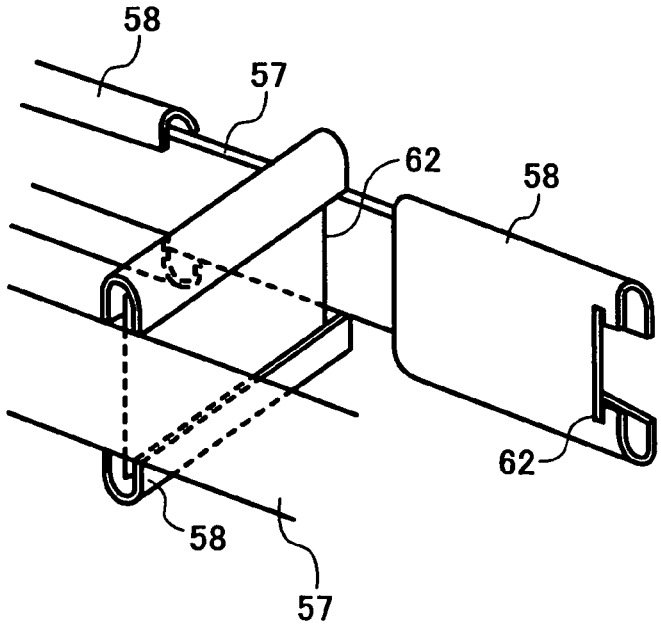
FIG. 18B is a perspective view thereof.

FIGS. 18A and 18B show modified examples of the embodiments shown in FIG. 14A to FIG. 16C. The groove-shaped body 58 has a notch groove 62 form at both ends thereof, and this notch groove 62 is used to attach the housing container perpendicular to the planar member 57, and a single partition body 55 can be divided into two for sectioning small spaces as shown in the drawings.

Embodiment 10

Figure 19:
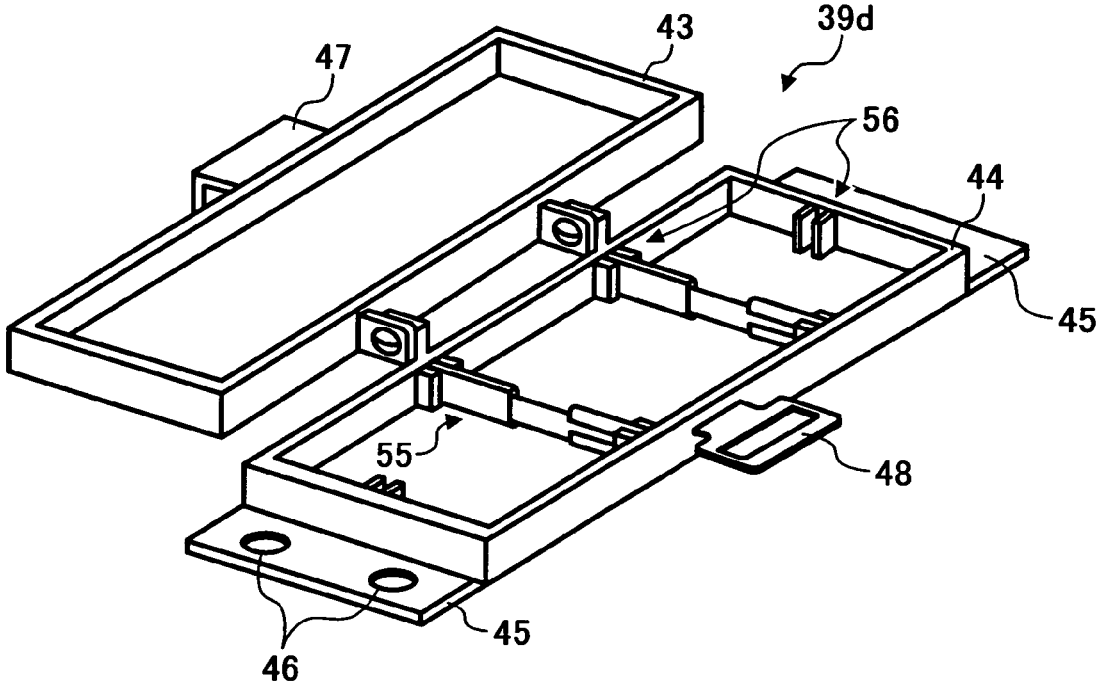
FIG. 19 is a perspective view showing the constitution of a modified example of the housing container illustrated in FIGS. 14A and 14B.

FIG. 19 shows a modified example of the embodiment shown in FIGS. 14A and 14B. The housing container 39*d* of this example, similar to the case of FIG. 9, a pair of attaching portions 45 is provided to the outside of the container portion 44, and screws are used to fix the housing member at a prescribed position.

Embodiment 11

Figure 20:
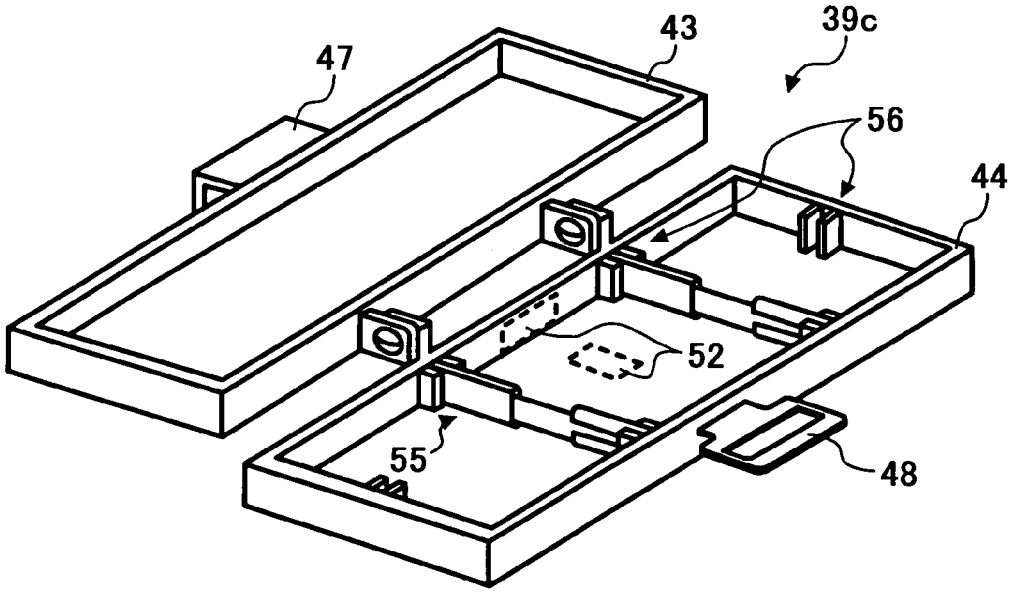
FIG. 20 is a perspective view showing the constitution of another modified example of the housing container illustrated in FIGS. 14A and 14B.

FIG. 20 shows yet another modified example of the housing container 39*c* shown in FIGS. 14A and 14B. In this example, as with the example shown in FIGS. 12A and 12B, a decal 52 is affixed too the bottom or side of the partition. The decal 52 is the same as those used in the example of FIG. 12. Further, similar to the example of FIG. 13, a plate 53 for sandwiching the outer wall of the housing container 39*a* or the partition wall may be used.

Embodiment 12

Figure 21:
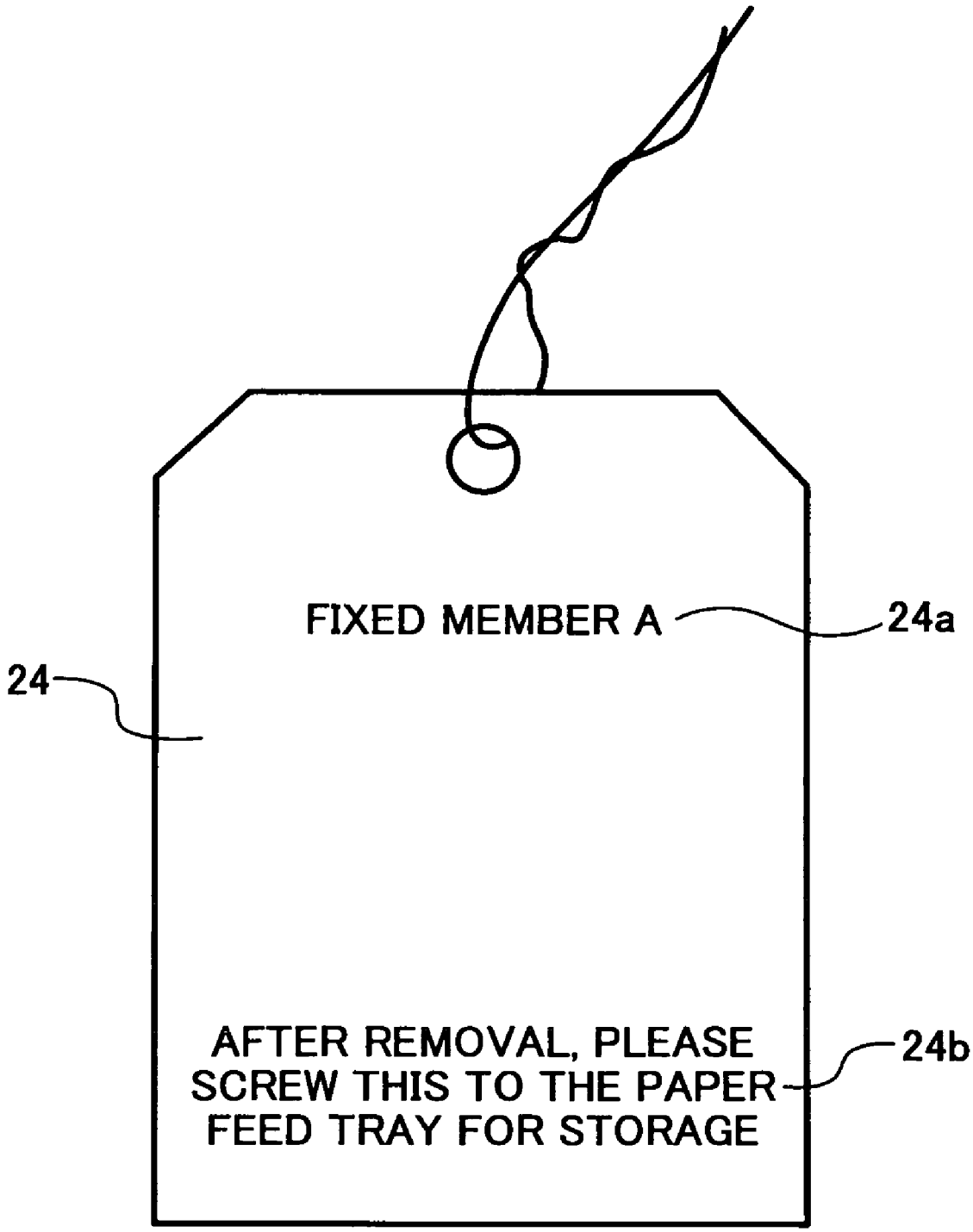
FIG. 21 is a diagram showing an example of the recognition member such as a tag to be attached to the fixation member or the like to be housed.

FIG. 21 shows an example of a recognition member such as a tag 24 to be attached to the fixation member to be housed. As the recognition member such as a tag 24, an indication 24*a* of the name of the fixation member, and, after the fixed member has been removed, and indication 24*b* to the effect that the items should be stored and housed should be formed by fixing the housing container with a screw inside the paper feed tray 15. Further, even if there are a plurality of types of fixation members to be housed, since the shape of the fixation members is predetermined, the shape, name and so on of the fixation member may be formed on the housing portion or housing container by engraving such indications to clarify the housing location. As a result, the worker will be able to easily recognize the fixation members to be housed, or the location where the fixation members should be housed.

As explained in the respective embodiments, if a container for housing the members removed from the apparatus is provided, at the time of collecting the image formation device and the like, the fixation means there were removed and housed can be used upon collecting the image formation device and the like, and the deterioration in collection quality can be suppressed. Further, since the fixation members can be stored by utilizing the open space in the paper feed tray or the like, it is possible to prevent the expansion of the space required for an apparatus such as an image formation device of providing only the function of storing the fixation members, and design restrictions can also be reduced. Further, in the recycle of reusing products collected from the market, since the removed components and the like are housed inside the housing container, scratches and damages to the outer cover can be prevented, quality securement upon reuse, reduction of disassembly procedures, and reduction in costs of reproducing image formation devices can be sought.

Further, as a result of fixing the fixation members that were removed in a open space in the product, it will be easy to know where the removed components are being stored, and the reduction of work hours for reproduction, quality securement upon reuse, and reduction in reproduction costs can be sought.

Further, as a result of employing a decal or tab and placing the removed members into the housing container, the quantity of each component such as the removed screw can be reliably grasped, and it is also possible to confirm whether such components have all been removed, and this will also contribute to the reduction of work hours for reproduction, and reduction in reproduction costs can be sought. In other words, it will be possible to prevent situations where components that should have been housed go missing, or not knowing which component and which component make a pair, which will confuse the worker to fix the fixation member. Further, a proper fixation procedures can be easily conducted without damaging the fixation member by combining erroneous members or damaging the units or components to be fixed.

Embodiment 13

FIG. 22A to 22E shows an embodiment pertaining to the constitution of attaching the outer cover of the image formation device 11. The outer cover 70 in this example is located at the lower side of the device body 12 positioned between the finisher 13 in FIGS. 1A, 1B, 2A and 2B, but the present embodiment is not limited thereto.

Figure 22A:
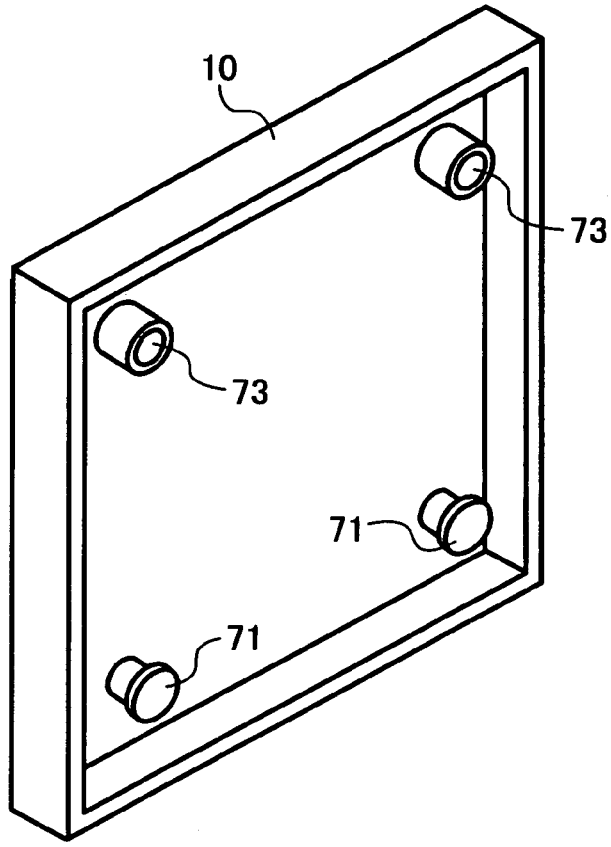
FIGS. 22A and 22B are perspective views showing an example of the constitution of attaching the outer cover of the image formation device.
Figure 22B:
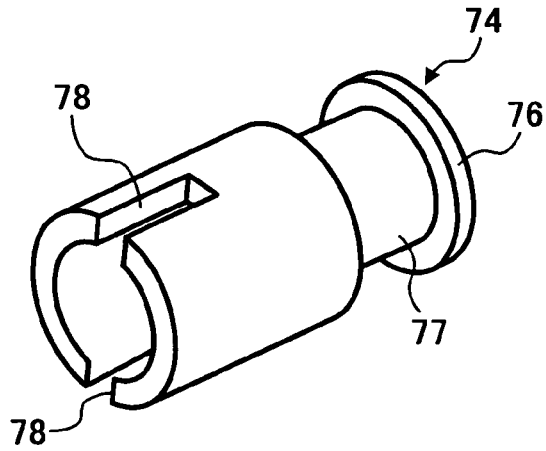

As shown in FIG. 22A, a pair of engagement protrusions 71, 71 and a pair of attachment holes 73, 73 for screwing the joining screw 72 are provided to the inside of the outer cover 70. The protrusion 71 is mounted by keeping a receptor 74 affixed to the hole provided to the case 12*a* constituting the device body 12 of the image formation device 11 and fitting the front end part thereto. Thus, a circular rib 75 is provide to the tip of the protrusion 71 with a broadening diameter.

The receptor 74 is a hollow cylindrical shape, and comprises the rib 76 and circular groove 77 for fitting into the hole provided to the case 12*a* of the device body 12, and a pair of slots 78, 78 is provided to the side protruding outward; that is, to the attachment side of the protrusion 71, and a circular concave groove 79 for fitting with the rib 75 of the protrusion 71 is formed inside.

Figure 22E:
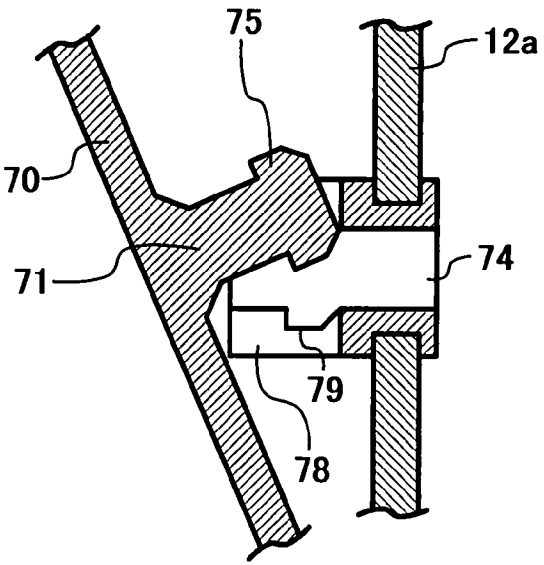
FIG. 22C to 22E are the cross sections thereof.
Figure 22D:
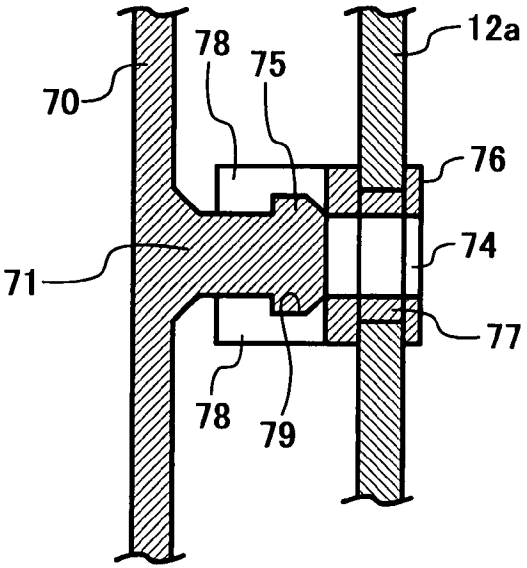
Figure 22C:
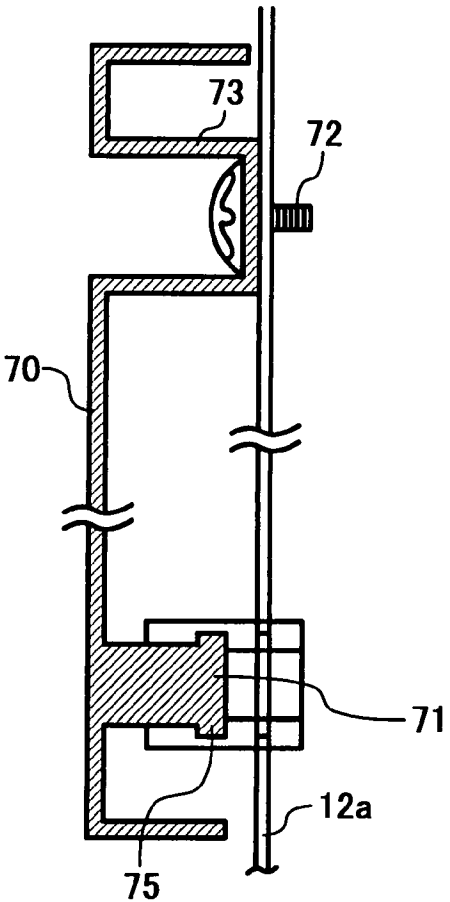

As shown in FIG. 22D, the protrusion 71 is inserted inside the receptor 74, the rib 75 is inserted and fitted into the concave groove 79 on the inside, and the foregoing joining screw 72 is used for retaining and fixing the outer cover 70. In order to remove the outer cover from this state, as shown in FIG. 22E, after removing the joining screw 72, the outer cover 70 is rotated around the bottom end that is lower than the engagement position of the receptor 74 and protrusion 71, the slot 78 of the receptor 74 is spread to the left and right with the protrusion 71, and the protrusion can be pulled out of the receptor 74 thereby. The outer cover 70 can be easily detached. The protrusion 71 of the outer cover 70 will not be damaged.

In the outer cover attachment mechanism of the present embodiment, since the outer cover can be detached simply by removing the joining screw 72 and slanting the outer cover 70 in the recycle of reusing products collected from the market, the labor and burden of workers can be alleviated. Further, while securing the quality upon reuse, it will also be simultaneously possible to reduce the number of components that need to be replaced with new components, reduce the replacement procedure in connection therewith, and reduce the reproduction cost.

Embodiment 14

Figure 23A:
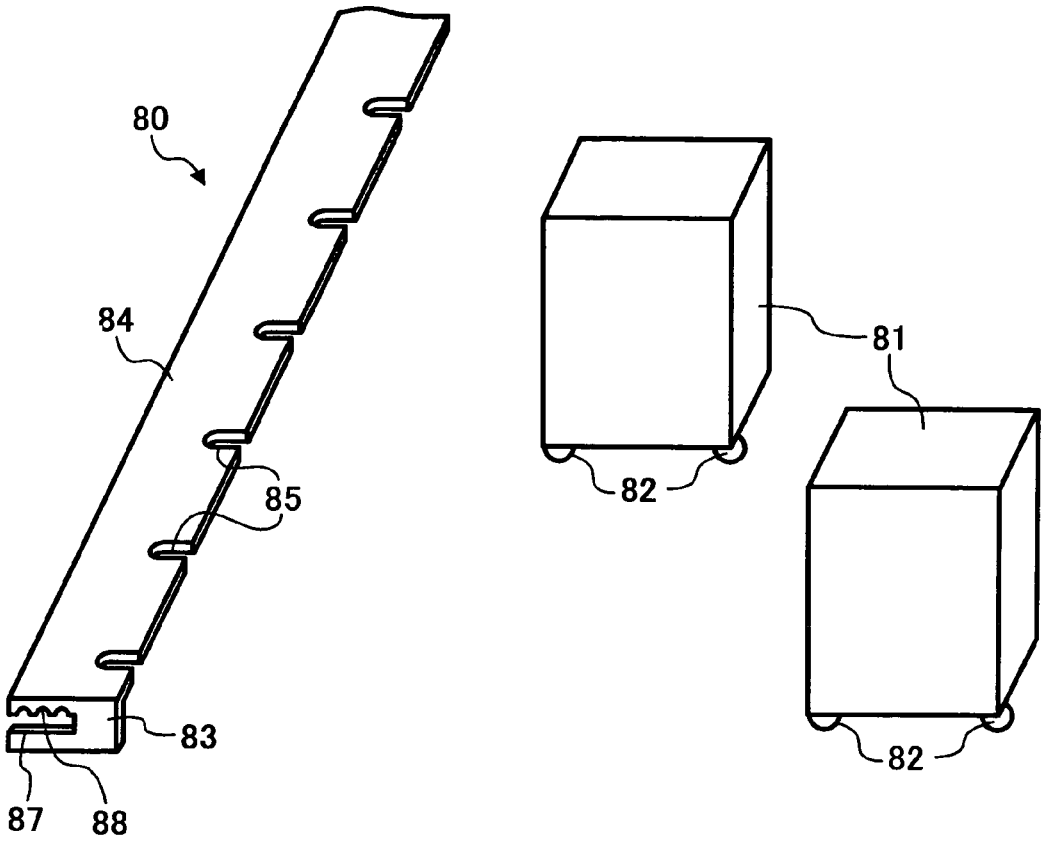
FIGS. 23A and 23B are perspective views showing an example of the apparatus position fixing body such as the main body of the image formation device.
Figure 23B:
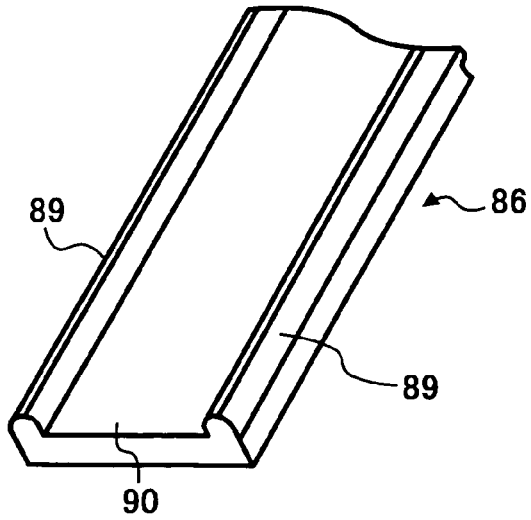

FIGS. 23A and 23B are perspective views showing an embodiment of the apparatus position fixing body to be used in transporting the device body 12 or the finisher 13 of the image formation device 11 subject to the processing of the fixation members and so on described above. The position fixing body 80 of this example is used to fix the position of the apparatus 81 by being attached to the leg or travelling member, a caster 82 for example, provided at the bottom part of the apparatus 81 such as the device body 12 or finisher 13. The position fixing body 80 is constituted by comprising a planar fixing portion 84 between a pair of legs 83 (only one is shown in the drawings), and a plurality of concave portions 85 for restricting the movement of the apparatus 81 upon fitting with the supporting portion of the caster 82 of the apparatus 81 are provided in the fixing portion 84. Needless to say, the height of the legs 83 can be disposed at a position in which the fixing portion 81 will be at a position that is lower than the bottom part of the apparatus 81.

The legs 83 having a groove 87 for inserting a buffering member 86 in which the opening direction thereof is opposite to the concave portion 85 of the fixing portion 84, and a plurality of concave portions 88 is provided facing downward to the groove 87. Meanwhile, the buffering member 86 comprises a pair of protrusions 89 engageable with the concave portions 88, and the a flat portion 90 is provided between the protrusions 89, 89.

Figure 24A:
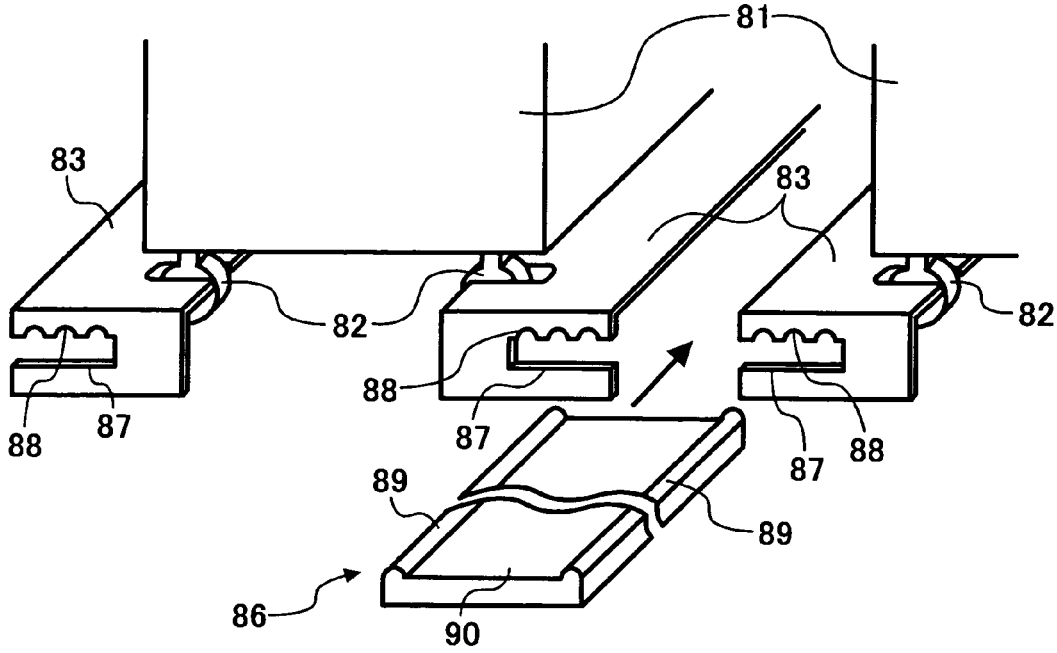
FIG. 24A is a perspective view for explaining an example of fixing or transporting apparatus with the position fixing body.
Figure 24B:
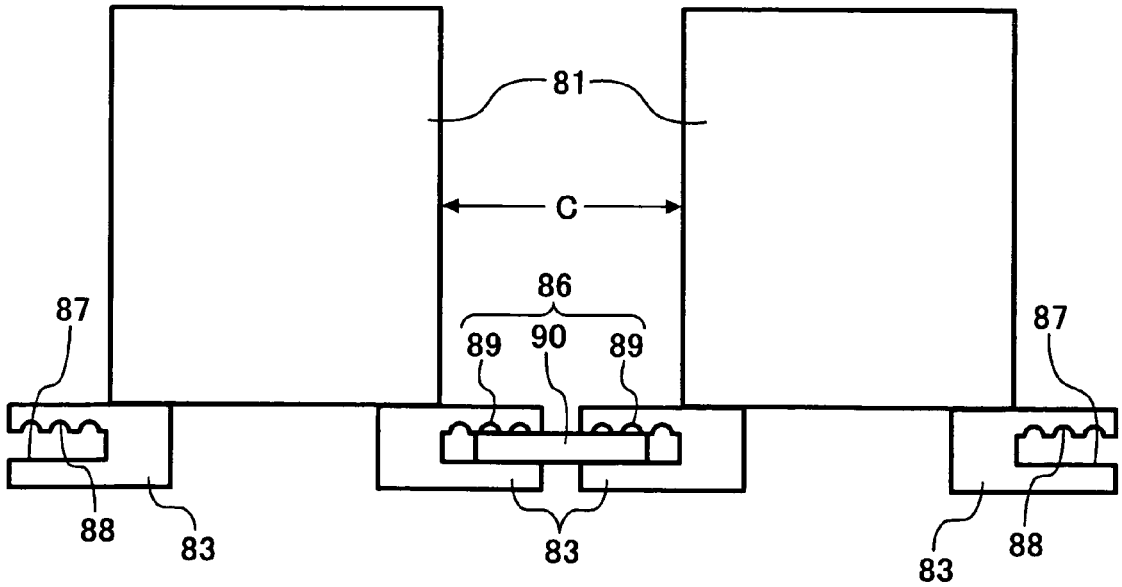
FIG. 24B is a front view thereof.

FIGS. 24A and 24B show examples of using a plurality of the position fixing bodies 80 of the apparatus 81 illustrated in FIGS. 23A and 23B to fix and transport a plurality apparatuses. Foremost, at least two pairs of position fixing bodies 80 is prepared, the supporting portion of the caster 82 is fitted into the concave portion 85 of the fixing portion 84, one or a plurality of apparatuses 81 are positioned from both sides so as to face each other, and, as shown in FIG. 24A, the position fixing bodies 80 are set to become parallel, and such that the space between the grooves 87, 87 of the adjacent position fixing bodies 80 is wide enough for the buffering member 86 to be inserted therein. Next, the buffering member 86 is inserted between the position fixing bodies 80, 80 such that the protrusion 89 thereof will be able to fit into any one of the concave portions 88 of the groove 87. This state is shown in FIG. 24B. As a result of adopting this state, the saccadic movement upon transferring the apparatuses on a truck or the like can be prevented. Incidentally, the size of the buffering member 86 can be changed according to the size of the apparatus 81 so as to adjust the distance C between the apparatuses 81, and the scratches or damages caused by the apparatuses 81 colliding with each other due to the shaking during the transport thereof can be prevented.

As described above, the present yields an effect of seeking the reduction of burden for the collection and reproduction, the reduction of replacement parts, and cost reduction of reproduced products in the recycle of collecting and reusing used products from the market.

Various modifications will become possible for those skilled in the art after receiving the teachings of the present disclosure without departing from the scope thereof.

What is claimed is:

1. An apparatus, comprising:

a connection member for connecting a peripheral device to the apparatus body; and a fixation member to be used for preventing the damage or the like of components and units inside said apparatus body upon transporting or moving said apparatus body;

wherein a housing container capable of housing said connection member and fixation member, and components for attaching said connection member to said apparatus body is provided fixably to said apparatus body.

2. An apparatus as claimed in claim 1, wherein said apparatus body has therein an open space for fixing said housing container.

3. An apparatus as claimed in claim 2, wherein the inside of said housing container is partitioned so as to enable the separate housing of said connection member and components.

4. An apparatus as claimed in claim 3, wherein the partition of said housing container is made variable to match the shape of the component to be housed.

5. An apparatus as claimed in claim 4, wherein said partition has an extendable divider mechanism.

6. An apparatus as claimed in claim 3, wherein a decal showing the shape or quantity of the removed connection member or components is attached to the bottom portion for each of said partitions.

7. An apparatus as claimed in claim 1, wherein said housing container has a cover with a lock mechanism.

8. An apparatus, comprising:

a connection member for connecting a peripheral device to the apparatus body; and a fixation member to be used for preventing the damage or the like of components and units inside said apparatus body upon transporting or moving said apparatus body;

wherein a housing portion capable of housing said connection member and fixation member, and components for attaching said connection member to said apparatus body is provided as a dead space inside said apparatus body.

9. An apparatus as claimed in claim 8, further comprising a housing body capable of housing items such as paper therein and which is retractable in said apparatus body, wherein said housing portion is provided inside said housing body.

10. An apparatus as claimed in claim 9, wherein said housing body is dedicated to housing items such as paper of a prescribed size.

11. An apparatus as claimed in claim 8, wherein said fixation member is used for fixing the movable portion of said apparatus body with a joining member, and said fixation member is attachable to said housing portion with said joining member.

12. An apparatus as claimed in claim 8, wherein an indication member such as a tag capable of forming an indication of storing said fixation member is connected to said fixation member.

13. An apparatus as claimed in claim 8, an indication of storing said fixed member in said housing portion is provided.

14. An image formation device, comprising:

a connection member for connecting a peripheral device to the image formation device body; and a fixation member to be used for preventing the damage or the like of components and units inside said image formation device body upon transporting or moving said image formation device body;

wherein a housing portion capable of housing said connection member and fixation member, and components for attaching said connection member to said image formation device body is provided as a dead space inside said image formation device body.

15. An image formation device as claimed in claim 14, further comprising a paper feed tray capable of housing items such as paper therein and which is retractable in said image formation device body, wherein said housing portion is provided inside said paper feed tray.

16. An image formation device as claimed in claim 15, wherein said paper feed tray is dedicated to housing items such as paper of a prescribed size.

17. An image formation device as claimed in claim 14, wherein said fixation member is used for fixing the movable portion of said image formation device body with a joining member, and said fixation member is attachable to said housing portion with said joining member.

18. An image formation device as claimed in claim 14, wherein an indication member such as a tag capable of forming an indication of storing said fixation member is connected to said fixation member.

19. An image formation device as claimed in claim 14, an indication of storing said fixed member in said housing portion is provided.

* * * * *